United States Patent [19]

Ichiyama et al.

[11] Patent Number: 4,627,013

[45] Date of Patent: Dec. 2, 1986

[54] LOAD WEIGHT INDICATING SYSTEM FOR LOAD MOVING MACHINE

[75] Inventors: Shuichi Ichiyama, Tsuchiura; Yukio Aoyagi, Ibaraki; Tomohiko Yasuda, Kashiwa, all of Japan

[73] Assignee: Hitachi Construction Machinery Co., Ltd., Tokyo, Japan

[21] Appl. No.: 556,403

[22] Filed: Nov. 30, 1983

[30] Foreign Application Priority Data

Dec. 1, 1982 [JP] Japan ..... 57-209245
Mar. 23, 1983 [JP] Japan ..... 58-47299
May 9, 1983 [JP] Japan ..... 58-79274

[51] Int. Cl.[4] ..... G06F 15/32; G06G 7/68; E02F 9/26

[52] U.S. Cl. ..... 364/567; 340/685; 364/463

[58] Field of Search ..... 364/424, 463, 567; 340/685

[56] References Cited

U.S. PATENT DOCUMENTS 3,819,922 6/1974 Horn et al. ..... 364/463 X
3,870,160 3/1975 Hutchings ..... 364/463 X
3,965,733 6/1976 Hutchings et al. ..... 364/424 X
4,006,347 2/1977 Hohmann ..... 364/463
4,044,610 8/1977 Oldaeus et al. ..... 73/862.54
4,133,032 1/1979 Spurling ..... 364/424
4,185,280 1/1980 Wilhelm ..... 364/424 X
4,332,517 6/1982 Igarashi et al. ..... 364/424 X

FOREIGN PATENT DOCUMENTS 2064794 6/1981 United Kingdom .
2072343 9/1981 United Kingdom .

*Primary Examiner*—Felix D. Gruber
*Attorney, Agent, or Firm*—Antonelli, Terry & Wands

[57] ABSTRACT

A load weight calculating system for a load moving machine, such as a hydraulic excavator, including a support, and a front attachment pivotably supported by the support. The front attachment includes a first linkage element pivotably supported by the support, a second linkage element pivotably supported by the first linkage element, a loading section supported by the second linkage element, and first and second hydraulic actuators for moving the first and second linkage elements, respectively. The load weight calculating system includes a first displacement detector and a second displacement detector for obtaining displacements $\alpha_1$ and $\beta_1$ of at least the first and second linkage elements, respectively, a pressing force sensor for obtaining a pressing force $K_1$ exerted by at least one of the first and second hydraulic actuators, a weight calculating unit for calculating the weight of a load carried by the loading section based on the values $\alpha_1$, $\beta_1$ and $K_1$ obtained at least by the first and second displacement detector and pressing force sensor, and a weight indicating unit for indicating a value associated with the load weight obtained by the weight calculating unit.

14 Claims, 22 Drawing Figures

LOAD WEIGHT INDICATING SYSTEM FOR LOAD MOVING MACHINE

BACKGROUND OF THE INVENTION

This invention relates to a load moving machine, such as a hydraulic excavator, in which a front attachment having a plurality of linkage elements is driven for moving a load, and more particularly it is concerned with a load weight indicating system for such load moving machine.

A load moving machine, such as a hydraulic excavator, provided with a front attachment having a plurality of linkage elements often performs the operation of moving a load from one position to another. This operation will be described by taking a hydraulic excavator as a typical example of such load moving machine.

Assume that a hydraulic excavator performs the operation of digging the earth to make a hole and loading a dump truck with sand removed from the earth. The operator of the excavator would suitably drive a boom, a shovel and a bucket of the hydraulic excavator to place in the bucket the sand removed from the earth and move an upper swing in swinging movement to transport the bucket to the dump truck standing by, to load the dump truck with the sand.

When this type of operation is performed, it has hitherto been usual practice to rely on measurements made by the operator with his eye to determine the weight of the load. Meanwhile, a dump truck has a rated loading capacity, and it has usually been the case that, when the weight of the load is merely measured with the eye of the operator, the load of the truck is greater or smaller than the loading capacity. Thus, when a load of sand placed on a dump truck actually exceeded or did not reach the rated loading capacity, problems would arise. If the load exceeded the loading capacity, trouble might occur in the dump truck and the dump truck might be involved in accident, thereby reducing its service life. Conversely, if the load were below the loading capacity, operation efficiency would drop.

In another type of operation of moving a heavy load by a hydraulic excavator, the hydraulic excavator has been used for feeding a large amount of limestone into a reaction furnace of a chemical plant. In this case, the weight of the limestone necessary for causing a reaction to take place is predetermined, so that it has been usual practice to measure the weight of the limestone before dumping same into the furnace by means of the dump truck. This is time-consuming and labor-wasting.

SUMMARY OF THE INVENTION

This invention has been developed for the purpose of obviating the aforesaid problems of the prior art. Accordingly, the invention has as its object the provision of a load moving machine with a load weight indicating system capable of informing the operator of the weight of a load placed on a dump truck.

According to the invention, there is provided a load weight indicating system for a load moving machine including a support, and a front attachment supported by the support for pivotal movement about a first pivot, the front attachment having a first linkage element supported by the support for pivotal movement about the first pivot, a second linkage element supported by the first linkage element for pivotal movement about a second pivot, a loading section supported by the second linkage element, and first and second hydraulic actuator means mounted for pivotally moving the first linkage element and the second linkage element respectively, the load weight calculating system comprising first and second displacement detector means for detecting displacements $\alpha_1$ and $\beta_1$ of at least the first linkage element and the second linkage element, respectively, of the front attachment, pressure sensor means for obtaining a pressing force $K_1$ exerted by at least one of the first and second hydraulic actuator, means of the front attachment, weight calculating means for calculating the weight of a load carried by the loading section based on the values $\alpha_1$, $\beta_1$ and $K_1$ obtained at least by the first and second displacement detector means and the pressing force sensor means, respectively, and weight indicating means for indicating a value associated with the load weight obtained by the weight calculating means.

Preferably, the weight calculating means is operative to perform, based on the values $\alpha_1$, $\beta_1$ and $K_1$ obtained at least by the first and second displacement detector means and the pressing force sensor means, the operations of: (a) calculating a moment of rotation $M_1$ of the front attachment about the first pivot when the loading section carries a load; (b) calculating a moment of rotation $M_2$ of the front attachment about the first pivot when the loading section carries no load; (c) calculating a horizontal distance $L_J$ between a position of the center of gravity of a load in the loading section and the first pivot; and (d) calculating $(M_1-M_2)/L_J$ to thereby obtain a weight of the load in the loading section.

DESCRIPTION OF THE PREFERRED EMBODIMENTS

The principle of calculation of the weight of a load according to the invention will be described by referring to FIGS. 1–4.

Figure 1:
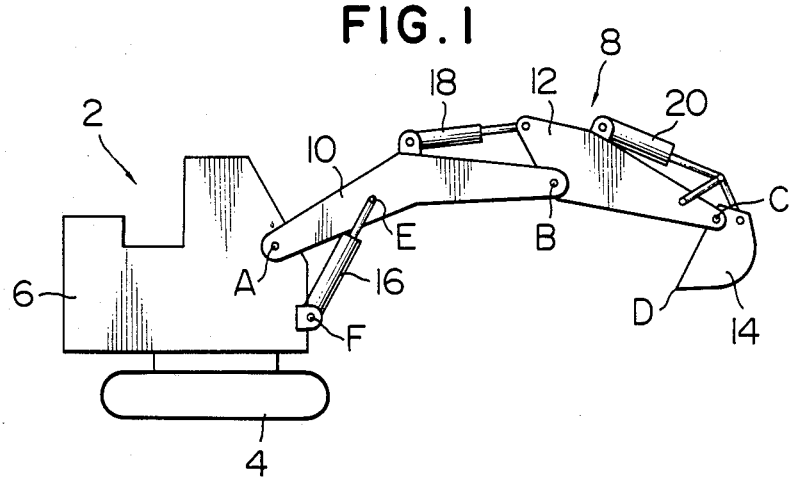
FIG. 1 is a schematic side view of a hydraulic excavator which is typical of the load moving machine in which the present invention is incorporated.

Referring to FIG. 1, the numeral 2 generally designates a hydraulic excavator as a typical example of the load moving machine in which the invention can be incorporated.

The hydraulic excavator 2 comprises a lower travel member 4, an upper swing 6 on the lower travel member 4 and a front attachment 8 pivotablly supported at a pivot A on the upper swing 6. The front attachment 8 includes a boom 10, an arm 12 and a bucket 14. The boom 10 is pivotablly supported at the pivot A; the arm 12 is pivotably supported at a pivot B on the boom 10; and the bucket 14 is pivotably supported at a pivot C on the arm 12. The bucket 14 has a forward end D. The boom 10 is moved by a boom cylinder 16 between a lying position and an upright position. The arm 12 is driven by an arm cylinder 18, and the bucket 14 is driven by a bucket cylinder 20. The boom cylinder 16 is pivotably supported at a pivot F on its bottom side on the upper swing 6 and at a pivot E on its rod side on the boom 10.

Figure 2:
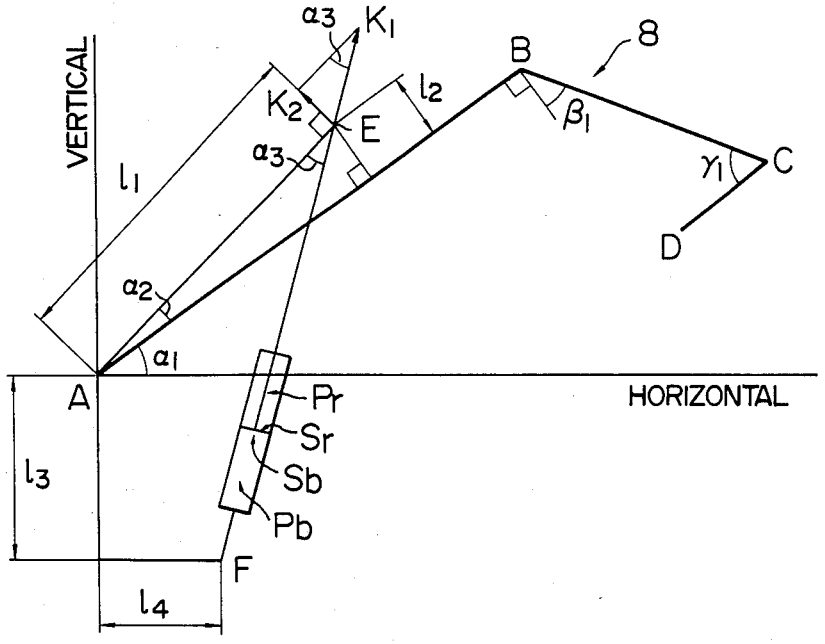
FIGS. 2, 3 and 4 are views in explanation of the principle of calculation of the weight of a load according to the invention, showing the front attachment of a hydraulic excavator in skeleton form with various kinds of measurements.
Figure 3:
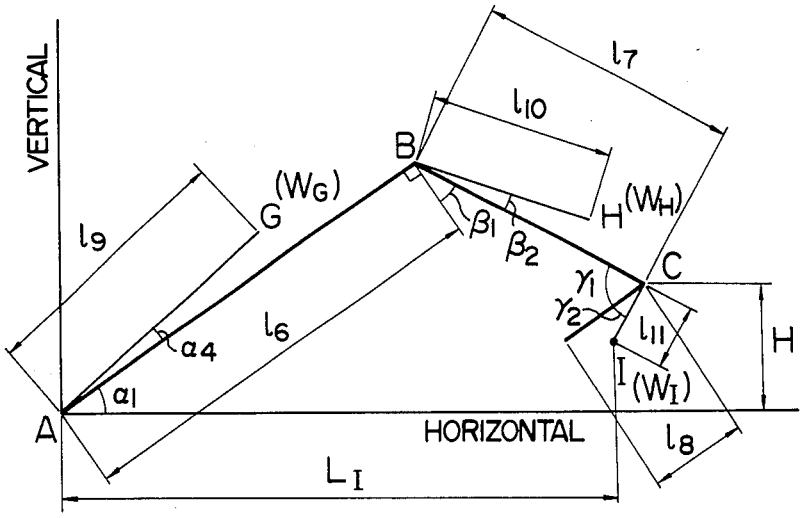
Figure 4:
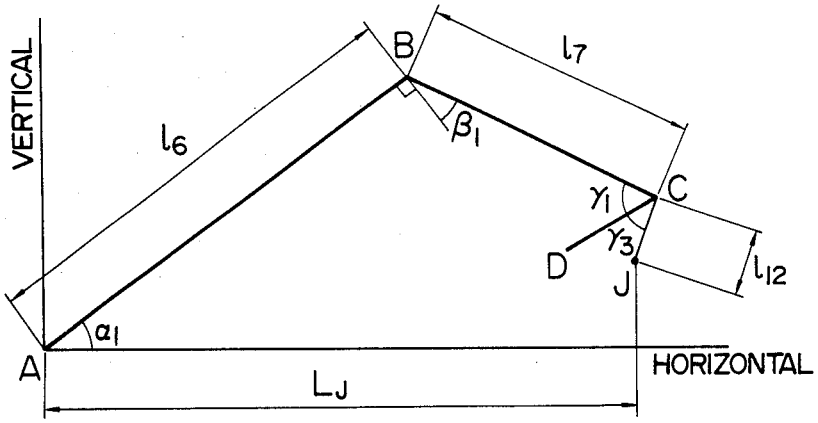

FIGS. 2–4 show in skeleton form the front attachment 8 of the hydraulic excavator 2 shown in FIG. 1, with its various kinds of measurements.

In FIG. 2, the boom pivot, arm pivot, bucket pivot, bucket forward end, boom cylinder rod pivot and boom cylinder bottom pivot shown in FIG. 1 are designated similarly by A, B, C, D, E and F, respectively. A boom angle formed by a horizontal plane at the pivot A and a straight line $\overline{AB}$ on the boom 10, an angle formed by the straight line $\overline{AB}$ and a straight line $\overline{AE}$, an angle formed by the boom cylinder rod and the straight line $\overline{AE}$, an arm angle which is an angle formed by the straight line $\overline{AB}$ and a straight line $\overline{BC}$ on the arm 12 minus 90 degrees and a bucket angle formed by the straight line $\overline{BC}$ and a straight line $\overline{CD}$ on the bucket 14 are designated by $\alpha_1$, $\alpha_2$, $\alpha_3$, $\beta_1$ and $\gamma_1$, respectively. A distance of the straight line $\overline{AE}$, a distance between the pivot E and an intersection of a line extending through the pivot E perpendicular to the straight line $\overline{AB}$ with the line $\overline{AB}$, a vertical distance between the pivots A and F and a horizontal distance between the pivots A and F are designated by $l_1$, $l_2$, $l_3$ and $l_4$, respectively. A bottom side pressure of the boom cylinder 16, a rod side pressure of the boom cylinder 16, a bottom side pressure receiving area of the boom cylinder 16 and a rod side pressure receiving area of the boom cylinder 16 are designated by $P_b$, $P_r$, $S_b$ and $S_r$, respectively. A pressing force exerted by the boom cylinder 16 is designated by $K_1$, and one of the components of the pressing force exerted by the boom cylinder is designated by $K_2$. Although only one boom cylinder 16 is shown and described hereinabove, two boom cylinders 16 are usually used with a hydraulic excavator, so that in the following description two boom cylinders 16 will be described as being used. All the moments of rotation will be described by referring to the pivot A.

In the front attachment 8 of the hydraulic excavator 2 in the aforesaid condition, the moment of rotation $M_1$ about the pivot A due to the total weight of the front attachment 8 and the moment of rotation given by the component $K_2$ of the pressing force $K_1$ exerted by the boom cylinder 16 balance, so that the moment $M_1$ can be expressed as follows:

$$M_1 = K_2 \times l_1 = K_1 \sin \alpha_3 \times l_1 \tag{1}$$

where the angle $\alpha_3$ can be expressed as follows:

$$\alpha_3 = 90^\circ - (\alpha_1 + \alpha_2) - \tan^{-1}\left\{ \frac{l_1\cos(\alpha_1 + \alpha_2) - l_4}{l_1\sin(\alpha_1 + \alpha_2) + l_3} \right\}$$

Thus, equation (1) can be rewritten as follows:

$$\begin{aligned} M_1 &= K_1 \times l_1 \times \\ &\sin\left[ 90^\circ - (\alpha_1 + \alpha_2) - \tan^{-1}\left\{ \frac{l_1\cos(\alpha_1 + \alpha_2) - l_4}{l_1\sin(\alpha_1 + \alpha_2) + l_3} \right\} \right] \\ &= K_1 \times \\ &l_1 \cos\left[ (\alpha_1 + \alpha_2) + \tan^{-1}\left\{ \frac{l_1\cos(\alpha_1 + \alpha_2) - l_4}{l_1\sin(\alpha_1 + \alpha_2) + l_3} \right\} \right] \\ &= K_1 \times l_1 \times \cos \phi \end{aligned} \tag{2}$$

where:

$$\phi = (\alpha_1 + \alpha_2) + \tan^{-1}\left\{ \frac{l_1\cos(\alpha_1 + \alpha_2) - l_4}{l_1\sin(\alpha_1 + \alpha_2) + l_3} \right\}$$

The boom cylinders 16 being two in number and located on opposite sides, the pressing force $K_1$ exerted by the boom cylinders 16 can be expressed as follows:

$$K_1 = 2 \times (P_b \cdot S_b - P_r \cdot S_r)$$

Therefore, equation (2) can be rewritten as follows:

$$M_1 = 2(P_b \cdot S_b - P_r \cdot S_r) \times l_1 \times \cos \phi \tag{3}$$

Let the moment $M_1$ be assumed to be one obtained when the bucket 14 carries a load.

Referring to FIG. 3, let the moment of rotation $M_2$ be obtained when the front attachment 8 is in the condition shown in FIG. 2 and no load is applied to the bucket 14 (or when the bucket 14 carries no load).

In FIG. 3, pivots and angles similar to those shown in FIG. 2 are designated by like reference characters. G is a position of the center of gravity of the boom 10, and $W_G$ is a weight of the boom 10. H is a position of the center of gravity of the arm 12, and $W_H$ is a weight of the arm 12. I is a position of the center of gravity of the bucket 14, and $W_I$ is a weight of the bucket 14. $\alpha_4$, $\beta_2$ and $\gamma_2$ are an angle formed by straight lines $\overline{AG}$ and $\overline{AB}$, an angle formed by straight lines $\overline{BC}$ and $\overline{BH}$ and an angle formed by straight lines $\overline{CD}$ and $\overline{CI}$, respectively. $l_6$, $l_7$, $l_8$, $l_9$, $l_{10}$ and $l_{11}$ are a length of the straight line $\overline{AB}$, a length of the straight line $\overline{BC}$, a length of the straight line $\overline{CD}$, a distance between the pivot A and the position of the center of gravity G, a distance between the pivot B and the position of the center of gravit H and a distance between the pivot C and the position of the center of gravity I, respectively.

When the front attachment 8 is in the aforesaid condition, a moment of rotation $M_2$ when there is no load can be expressed as follows:

$$M_2 = W_G \cdot l_9\cos(\alpha_1 + \alpha_4) + W_H \cdot \{l_6\cos\alpha_1 + l_{10}\sin(\alpha_1 + \beta_1 + \beta_2)\} + W_I \cdot \{l_6\cos\alpha_1 + l_7\sin(\alpha_1 + \beta_1) - l_{11}\sin(\alpha_1 + \beta_1 + \gamma_1 + \gamma_2) \quad (4)$$

Equation (3) shows a moment of rotation about the pivot A when the bucket 14 carries a load, and equation (4) shows a moment of rotation about the pivot A when the bucket 14 carries no load, so that a moment of rotation $M_3$ about the pivot A produced by the load of the bucket 14 itself is obtained by the following equation:

$$M_3 = M_1 - M_2 \quad (5)$$

To obtain a weight $W_J$ of the load of the bucket 14, a horizontal distance between a position of the center of gravity of the load and the pivot A is obtained by referring to FIG. 4 in which pivots, positions and lengths similar to those shown in FIG. 3 are designated by like reference characters. J is a position of the center of gravity of the load applied to the bucket 14. $l_3$ is an angle formed by straight lines $\overline{CD}$ and $\overline{CJ}$ and $l_{12}$ is a distance between the pivot C and the position J of the center of gravity. The horizontal distance referred to hereinabove is expressed as a horizontal distance $L_J$ between the pivot A and the position J of the center of gravity.

Thus, the distance $L_J$ can be expressed by the following equation:

$$L_J = l_6\cos\alpha_1 + l_7\sin(\alpha_1+\beta_1) - l_{12}\sin(\alpha_1+\beta_1+\gamma_1+\gamma_3) \quad (6)$$

The weight $W_J$ of the load carried by the bucket 14 can be expressed by the following equation:

$$W_J = M_3/L_J \quad (7)$$

A preferred embodiment of the invention based on the theory of calculation described hereinabove will now be described.

Figure 5:
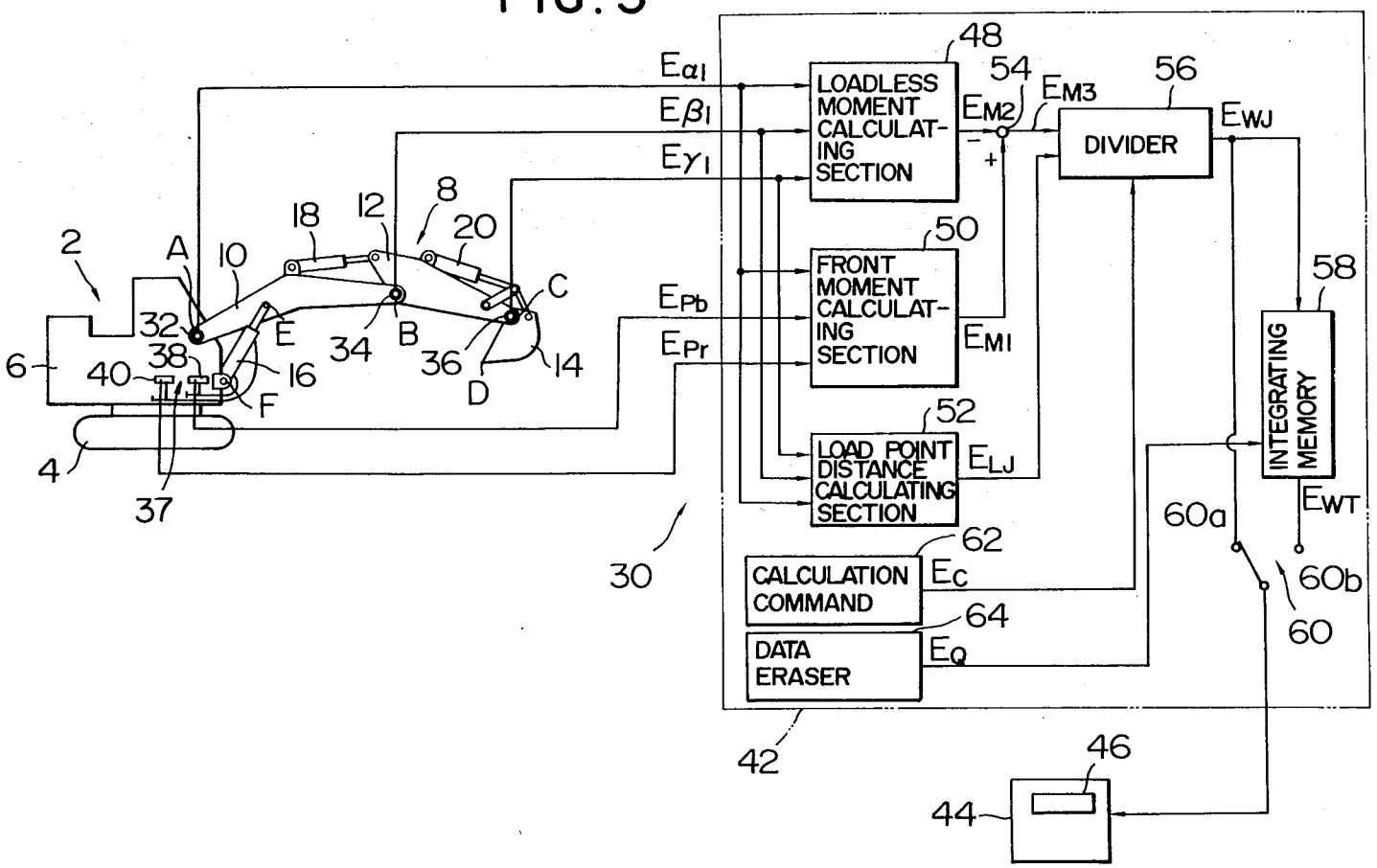
FIG. 5 is a block diagram of the load weight indicating system comprising a first embodiment of the invention.

In FIG. 5, a load weight indicating system for the hydraulic excavator 2 comprising one embodiment of the invention is generally designated by the reference character 30.

The system 30 comprises angle detectors 32, 34 and 36 located at the pivots A, B and C of pivotal movement, respectively, of the front attachment 8 of the hydraulic excavator 2 for detecting the boom angle $\alpha_1$, arm angle $\beta_1$ and bucket angle $\gamma_1$ and producing signals $E_{\alpha 1}$, $E_{\beta 1}$ and $E_{\gamma 1}$ corresponding to the detected angles, respectively. The system 30 further comprises a pressing force sensor 37 including pressure sensors 38 and 40 for sensing the pressures $P_b$ and $P_r$ on the bottom side and rod side, respectively, of the boom cylinder 16 associated with the pressing force K, and producing signals $E_{pb}$ and $E_{pr}$ corresponding to the pressures $P_b$ and $P_r$, respectively. The system 30 further comprises a load weight calculating unit 42, and a load weight indicating unit 44 receiving a signal produced by the load weight calculating unit 42. The indicating unit 44 comprises an indicating surface 46 for indicating the weight. The calculating unit 42 comprises a loadless moment calculating section 48 having the signals $E_{\alpha 1}$, $E_{\beta 1}$ and $E_{\gamma 1}$ inputted thereto and operative to perform calculation thereon to obtain the moment of rotation $M_2$ and output a signal $E_{M2}$ indicative of the moment $M_2$, a front moment calculating section 50 having inputted thereto the signals $E_{\alpha 1}$, $E_{pb}$ and $E_{pr}$ and operative to perform calculation thereon to obtain the moment of rotation $M_1$ and output a signal $E_{M1}$ indicative of the moment $M_1$, a load point distance calculating section 52 having inputted thereto the signals $E_{\alpha 1}$, $E_{\beta 1}$ and $E_{\gamma 1}$ and operative to perform calculation thereon to obtain the horizontal distance $L_J$ and output a signal $E_{LJ}$ indicative of the distance $L_J$, a subtracter 54 having inputted thereto the signals $E_{M2}$ and $E_{M1}$ and operative to perform calculation thereon to obtain the difference between them and output a signal $E_{M3}$ indicative of the difference, a divider 56 having inputted thereto the signals $E_{M3}$ and $E_{LJ}$ and operative to perform calculation thereon to obtain the ratio $E_{M3}/E_{LJ}$ and output a signal $E_{WJ}$ indicative of the value, an integrating memory 58 operative to integrate the value of a load weight indicated by the signal $E_{WJ}$ from the divider 56 and store the value of the integrated load weight and output a signal $E_{WT}$ indicative of the stored value, an indication switch 60 for switching between the indications of a load weight obtained each time corresponding to the signal $E_{WJ}$ and of an integrated load weight corresponding to the signal $E_{WT}$, a calculation commanding switch 62 for producing an output signal $E_c$ to give a command to the divider 56 to perform calculation of the load weight, and a data eraser switch 64 for producing an output signal $E_Q$ for erasing data stored in the integrating memory 58.

Figure 6:
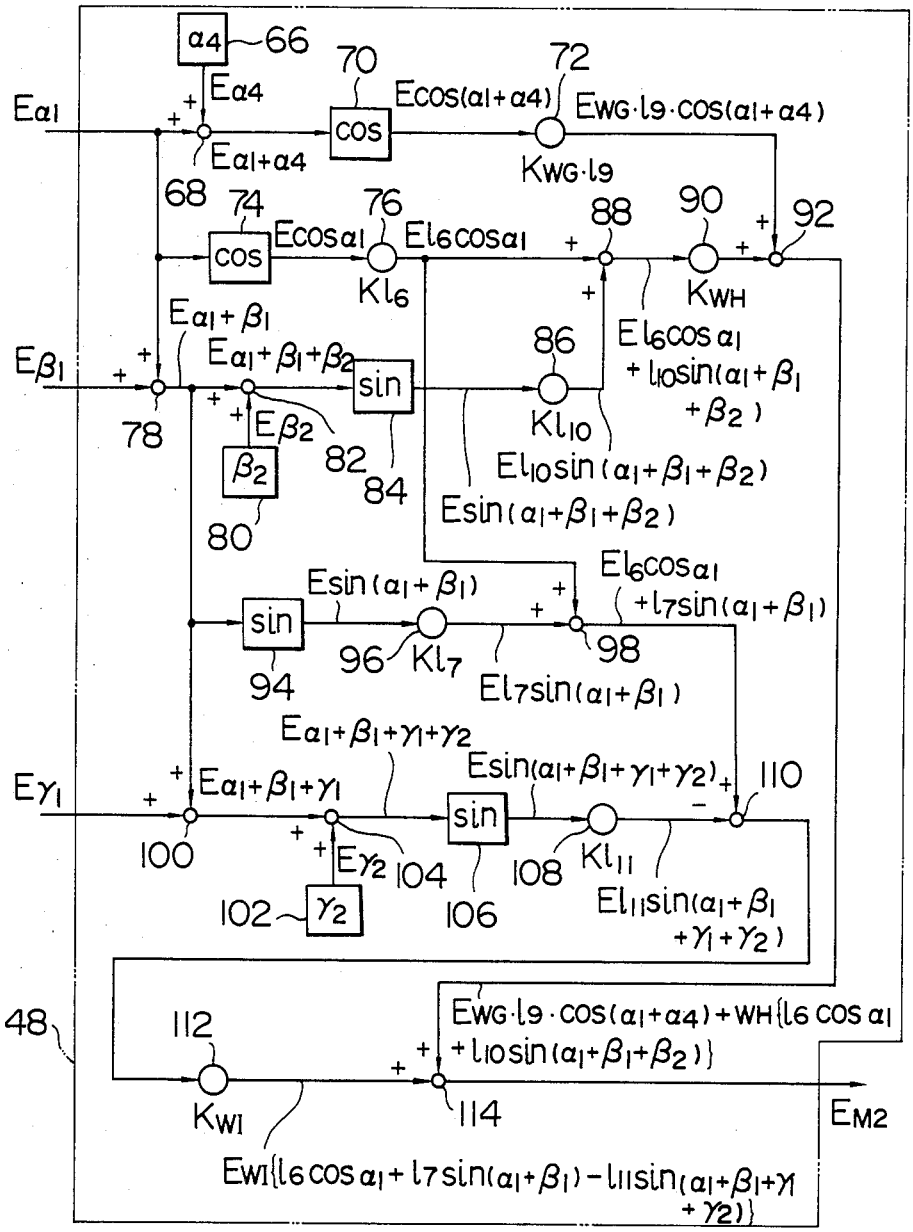
FIGS. 6, 7 and 8 are block diagrams showing the constructions of the loadless moment calculating section, the front moment calculating section and the load point distance calculating section, respectively, shown in FIG. 5.

The construction and operation of the loadless moment calculating section 48 will be described by referring to FIG. 6.

The boom angle signal $E_{\alpha 1}$ from the angle detector 32 and a signal $E_{\alpha 4}$ of the angle $\alpha_4$ stored in a memory 66 are added to each other at an adder 68 which produces a signal $E_{\alpha 1+\alpha 4}$ which is inputted to a trigonometric function generator 70 from which a signal $E_{\cos(\alpha 1+\alpha 4)}$ corresponding to the cosine of an angle $(\alpha_1+\alpha_4)$ is taken out. The signal $E_{\cos(\alpha 1+\alpha 4)}$ is then supplied to a coefficient generator 72 where it is multiplied by a signal corresponding to a value indicative of the weight $W_G$ multiplied by the distance $l_9$ to produce a signal $E_{WG \cdot l9 \cdot \cos(\alpha 1+\alpha 4)}$. Meanwhile, the signal $E_{\alpha 1}$ is inputted to a trigonometric function generator 74 from which a signal $E_{\cos\alpha 1}$ corresponding to the cosine of the angle $\alpha_1$ is taken out and supplied to a coefficient generator 76 where it is multiplied by a signal corresponding to the distance $l_6$ to produce a signal $E_{l6\cos\alpha 1}$. The arm signal $E_{\beta 1}$ and the boom signal $E_{\alpha 1}$ are added to each other at an adder 78 to produce a signal $E_{\alpha 1+\beta 1}$ to which a signal $E_{\beta 2}$ corresponding to the angle $\beta_2$ stored in a memory 80 is added at an adder 82 to produce a signal $E_{\alpha 1+\beta 1+\beta 2}$. This signal is inputted to a trigonometric function generator 84 from which a signal $E_{\sin(\alpha 1+\beta 1+\beta 2)}$ corresponding to the sine of an angle $(\alpha_1+\beta_1+\beta_2)$ is taken out and supplied to a coefficient generator 86 where it is multiplied by a signal corresponding to the distance $l_{10}$ to produce a signal $E_{l10\sin(\alpha 1+\beta 1+\beta 2)}$. To this signal, the signal $E_{l6\cos\alpha 1}$ is added at an adder 88 and the resultant signal is multiplied by a signal corresponding to the weight $W_H$ at a coefficient generator 90 to produce a signal $E_{WH\{l6\cos\alpha 1+l10\sin}$-

$(\alpha_1+\beta_1+\beta_2)\}$. To this signal, the signal $E_{WG \cdot l9 \cdot cos(\alpha 1+\alpha 4)}$ is addded at an adder 92 to produce a signal $E_{WG \cdot l9 \cdot cos(\alpha 1+\alpha 4)+WH\{l6 \cdot cos\ \alpha 1+l10\ sin(\alpha 1+\beta 1+\beta 2)\}}$.

The output signal $E_{\alpha 1+\beta 1}$ produced by the adder 78 is inputted to a trigonometric function generator 94 from which a signal $E_{sin(\alpha 1+\beta 1)}$ corresponding to the sine of an angle $(\alpha 1+\beta 1)$ is taken out and multiplied by a signal corresponding to the distance $l_7$ at a coefficient generator 96 to produce a signal $E_{l7\ sin(\alpha 1+\beta 1)}$. This signal is added to the output signal of the coefficient generator 76 at an adder 98 to produce a signal $E_{l6\ cos\ \alpha 1+l7\ sin(\alpha 1+\beta 1)}$. To the output signal of the adder 78 is added a bucket angle signal $E_{\gamma 1}$ to produce asignal $E_{\alpha 1+\beta 1+\gamma 1}$ to which a signal $E_{\gamma 2}$ corresponding to the angle $\gamma_2$ stored in a memory 102 is further added at an adder 104 to produce a signal $E_{\alpha 1+\beta 1+\gamma 1+\gamma 2}$. This signal is inputted to a trigonometric function generator 106 from which a signal $E_{sin(\alpha 1+\beta 1+\gamma 1+\gamma 2)}$ corresponding to the sine of an angle $(\alpha_1+\beta_1+\gamma_1+\gamma_2)$ is taken out which is multiplied by a signal corresponding to the distance $l_{11}$ at a function generator 108 to produce a signal $E_{l11\ sin(\alpha 1+\beta 1+\gamma 1+\gamma 2)}$. This signal is multiplied by a signal corresponding to the weight $W_I$ at a coefficient generator 112 after the output signal of the adder 98 is subtracted therefrom at a subtracter 110, to produce a signal $E_{WI\{l6\ cos\ \alpha 1+l7\ sin(\alpha 1+\beta 1)-l11\ sin(\alpha 1+\beta 1+\gamma 1+\gamma 2)\}}$. This signal is added at an adder 114 to the output signal of the adder 92 to produce a signal $E_{M2}$ which corresponds to the loadless moment $M_2$ shown in equation (4).

The construction and operation of the front moment calculator 50 shown in FIG. 5 will be described by referring to FIG. 7. The boom angle signal $E_{\alpha 1}$ is added at an adder 116 to a signal $E_{\alpha 2}$ corresponding to the angle $\alpha_2$ stored in a memory 118 to produce a signal $E_{\alpha 1+\alpha 2}$ which is inputted to a trigonometric function generator 120 from which a signal $E_{sin(\alpha 1+\alpha 2)}$ corresponding to the sine of an angle $(\alpha_1+\alpha_2)$ is taken out. This signal is multiplied by a signal corresponding to the distance $l_1$ at a coefficient generator 122 to produce a signal $E_{l1\ sin(\alpha 1+\alpha 2)}$. To this signal, a signal corresponding to the value $l_3$ stored in a memory 126 is added at an adder 124, to produce a signal $E_{l1\ sin(\alpha 1+\alpha 2)+l3}$. Meanwhile, the output signal produced by the adder 116 is inputted to a trigonometric function generator 128 from which a signal $E_{cos(\alpha 1+\alpha 2)}$ corresponding to the cosine of an angle $(\alpha_1+\alpha_2)$ is taken out and multiplied, at a coefficient generator 130, by a signal corresponding to the distance $l_1$ to produce a signal $E_{l1\ cos(\alpha 1+\alpha 2)}$. From this signal, a signal $E_{l4}$ corresponding to the value $l_4$ stored in a memory 134 is subtracted at a subtracter 132, which produces a signal $E_{l1\ cos(\alpha 1+\alpha 2)-l4}$. The output signal of the subtracter 132 is divided by the output signal of the adder 124 at a divider 136 whose output signal corresponding to the quotient is inputted to an inverse trigonometric function generator 138 from which the following signal corresponding to the inverse tangent of the signal is taken out:

$$E\tan^{-1}\left\{\frac{l_1\cos(\alpha_1+\alpha_2)-l_4}{l_1\sin(\alpha_1+\alpha_2)+l_3}\right\}$$

To the signal thus taken out, the output signal $E_{\alpha 1+\alpha 2}$ of the adder 116 is added at an adder 140 to produce a signal $E_\phi$ which is inputted to a trigonometric function generator 142 from which a signal $E_{cos\phi}$ corresponding to the cosine of the angle $\phi$ is taken out and multiplied by a signal corresponding to a value $2l_1$ at a coefficient generator 148 to produce a signal $E_{2l1\ cos\phi}$. Meanwhile, the bottom side pressure signal $E_{pb}$ of the boom cylinder 16 from the pressure sensor 38 is supplied to a coefficient generator 150 where it is multiplied by a signal corresponding to the value $S_b$ to produce a signal $E_{Pb \cdot Sb}$. The rod side pressure signal $E_{pr}$ of the boom cylinder 16 from the pressure sensor 40 is supplied to a coefficient generator 152 where it is multiplied by a signal corresponding to the value $S_r$ to produce a signal $E_{Pr \cdot Sr}$. Subtraction is performed on these two signals at a subtracter 154 to obtain a signal $E_{(Pb \cdot Sb-Pr \cdot Sr)}$. This signal and the output signal of the coefficient generator 148 are inputted to a multiplier 156 and multiplification is performed thereon to produce a signal $E_{M1}$ which corresponds to the moment of rotation $M_1$ about the pivot A as shown by equation (3).

The construction and operation of the load point distance calculating section 52 shown in FIG. 5 will be described by referring to FIG. 8. The boom angle signal $E_{\alpha 1}$ is inputted to a trigonometric function generator 158 from which a signal $E_{cos\ \alpha 1}$ corresponding to the cosine of the angle $\alpha_1$ is taken out. The signal $E_{cos\ \alpha 1}$ is multiplied by a signal corresponding to the distance $l_6$ at a coefficient generator 160 to produce a signal $E_{l6\ cos\ \alpha 1}$. Meanwhile, the arm signal $E_{\alpha 1}$ is added to the boom signal at an adder 162 to produce a signal $E_{\alpha 1+\beta 1}$ which is inputted to a trigonometric function generator 164 from which a signal $E_{sin(\alpha 1+\beta 1)}$ corresponding to the sine of an angle $(\alpha_1+\beta_1)$ is taken out. This signal is multiplied by a signal corresponding to the distance $l_7$ at a coefficient generator 166 to produce a signal $E_{l7\ sin(\alpha 1+\beta 1)}$. This signal is added to the output signal of the coefficient generator 160 at an adder 168 to produce a signal $E_{l6\ cos\ \alpha 1+l7\ sin(\alpha 1+\beta 1)}$. The bucket angle signal $E_{\gamma 1}$ is added to the output signal $E_{\alpha 1+\beta 1}$ of the adder 162 at an adder 170 to produce a signal $E_{\alpha 1+\beta 1+\gamma 1}$, to which a signal $E_{\gamma 3}$ corresponding to the value $\gamma_3$ stored in a memory 174 is further added at an adder 172 to produce a signal $E_{\alpha 1+\beta 1+\gamma 1+\gamma 3}$. This signal is inputted to a trigonometric function generator 176 from which a signal corresponding to the sine of an angle $(\alpha_1+\beta_1+\gamma_1+\gamma_3)$ is obtained. This signal is multiplied by a signal corresponding to the distance $l_{12}$ at a coefficient generator 178 to produce a signal $E_{l12\ sin(\alpha 1+\beta 1+\gamma 1+\gamma 3)}$. Subtraction is performed on this signal and the output signal of the adder 168 at a subtracter 180 to produce a signal $E_{LJ}$, which corresponds to the horizontal distance $L_J$ between the pivot A and the position of the center of gravity J shown by equation (6).

Referring to FIG. 5 again, subtraction is performed on the output signal $E_{M2}$ of the loadless moment calculating section 48 and the signal $E_{M1}$ of the front moment calculating section 50 at the subtractor 54 to produce a signal $E_{M3}$ corresponding to the moment $M_3$ shown by equation (5). This signal is divided by an output signal $E_{LJ}$ of the load point distance calculating section 52 at the divider 56 to produce a signal $E_{WJ}$ corresponding section 52 at the divider 56 to produce a signal $E_{WJ}$ corresponding to the weight $W_J$ shown by equation (7). That is, the signal $E_{WJ}$ obtained by the divider 56 represents a value corresponding to the weight of a load carried by the bucket 14. The divider 56 is constructed such that it is rendered operative to perform a dividing operation when a signal $E_c$ produced by the calculation commanding switch 62 is inputted thereto. Thus, if the operator of the hydraulic excavator actuates the switch 62 when the bucket 14 carrying a load clears the ground, then the signal $E_c$ is produced and the divider 56 is rendered operative to produce the load weight signal $E_{WJ}$. When the switch 60 is in a position to contact a terminal 60*a*, the signal $E_{WJ}$ is immediately inputted to the indicating section 44 so as to give indication of the weight of the load in the bucket 14 on the indicating surface 46.

The integrating memory 58 is operative to perform integration on the signal $E_{WJ}$ produced by the divider 56 each time it is produced to add the values of the signals together and store a value obtained by integration. As the switch 60 is brought into contact with a terminal 60*b*, a signal $E_{WT}$ corresponding to the value obtained by integration is produced, so as to give an indication of the value obtained by integration of the weight of the load on the indicating surface 46 of the indicating unit 44.

Thus, when the operation of loading a dump truck with sand is performed, the weight of sand placed on the truck in one bucket operation can be indicated on the indicating surface 46 if the switch 60 is brought into contact with the terminal 60*a*, and the total weight of the sand on the truck can be indicated on the indicating surface 46 if the switch 60 is brought into contact with the terminal 60*b*. This makes it possible to optimize the weight of the sand placed on the truck. The same is true of the operation referred to hereinabove with respect to a chemical plant. When operation of loading a dump truck with sand or feeding a predetermined amount of chemical substance into a reaction furnace of a chemical plate is finished, the operator of the hydraulic excavator actuates the data eraser switch 64 to supply an erasing signal $E_Q$ to the integrating memory 58 to remove from the memory 58 the value obtained by integration and stored therein to thereby let the memory 58 stand by for another operation of obtaining the weight of a load by integration.

The output of the integrating memory 58 may be supplied as an input to a comparator to which any arbitrarily selected value, such as a rated load weight of a dump truck, may be supplied as another input, and the comparator may be rendered operative to output a signal to give a visual indication or sound an alarm when the output of the integrating memory 58 reaches the selected value.

In the embodiment shown and described hereinabove, a moment and a load point distance are obtained both when the bucket carriers a load and when the bucket carries no load by using signals produced by the angle detectors and pressure sensors of the boom cylinder, and calculation is done on the values obtained to determine the weight of a load carried by the bucket to thereby indicate the weight of a load delivered in one bucket operation to the truck or the total weight of the load on the truck. Thus, it is possible to learn immediately the weight of a load carried by the bucket of the hydraulic excavator or the total weight of the load carried thereby to the truck.

In the embodiment shown and described hereinabove, the invention has been described as being incorporated in a hydraulic excavator. However, this is not restrictive, and the invention may have application in any other load moving machine, which has a front attachment including a plurality of linkage elements and an loading section.

Also, the invention has been described as being incorporated in a hydraulic excavator having a bucket supported at a forward end of an arm. However, the invention is not limited to the bucket, and it may have application in any other loading section. The magnitudes of displacements of the boom, arm and bucket have been described as being detected by the angle detector. However, this is not restrictive and the magnitude of a displacement of a piston rod of each cylinder may be detected instead.

The drive pressures of the boom cylinder have been described as being sensed as pressure signals. However, this is not restrictive and a drive pressure of any other cylinder of the front attachment than the boom cylinder may be sensed to provide a pressure signal. The drive pressures have been sensed to determine the pressing force exerted by a cylinder. However, this is not restrictive and the pressing force may be directly sensed as by a strain gauge in place of sensing the drive pressures. Moreover, since the displacement of a bucket is small in magnitude when a load is moved, a typical value of displacement may be set as a constant beforehand and the weight of a load may be approximately determined only by detecting the displacements of the boom and arm. By using a suitable form of integrating memory or additionally using another integrating memory besides the integrating memory being used, it is possible to determine the total weight of loads handled over a prolonged period of time (one day, one week or one month). The integrating memory and indication switch may be provided to the indicating unit and only the weight of a load handled in one operation may be outputted from the calculating unit.

From the foregoing description, it will be appreciated that according to the invention the weight of a load applied to a front attachment is calculated at least based on the values of displacements of the boom and arm and the pressing force exerted by the boom cylinder, and the weight of the load, determined as a value of one batch or as a value obtained by integration, can be indicated. Thus, the invention offers the advantage that information on the weight of a load carried by the load moving machine or the total weight of a load carried for a predetermined period of time or number can be readily obtained.

The principle of calculation of the weight of a load performed by a second embodiment of the invention will be described by referring to FIGS. 9–11.

The principle of calculation of the weight of a load performed by the embodiment of the invention described by referring to FIGS. 2–4 is based on the assumption that the upper swing 6 of the hydraulic excavator 2 is located horizontally on the ground. In actual operation, however, the hydraulic excavator is sometimes forced to perform operations when the upper swing 6 is in a tilting position. FIGS. 9–11 are views corresponding to FIGS. 2–4, respectively, showing various parts of the hydraulic excavator located in a tilting position. In FIGS. 9–11, parts similar to those shown in FIGS. 2–4 are designated by like reference characters.

Figure 9:
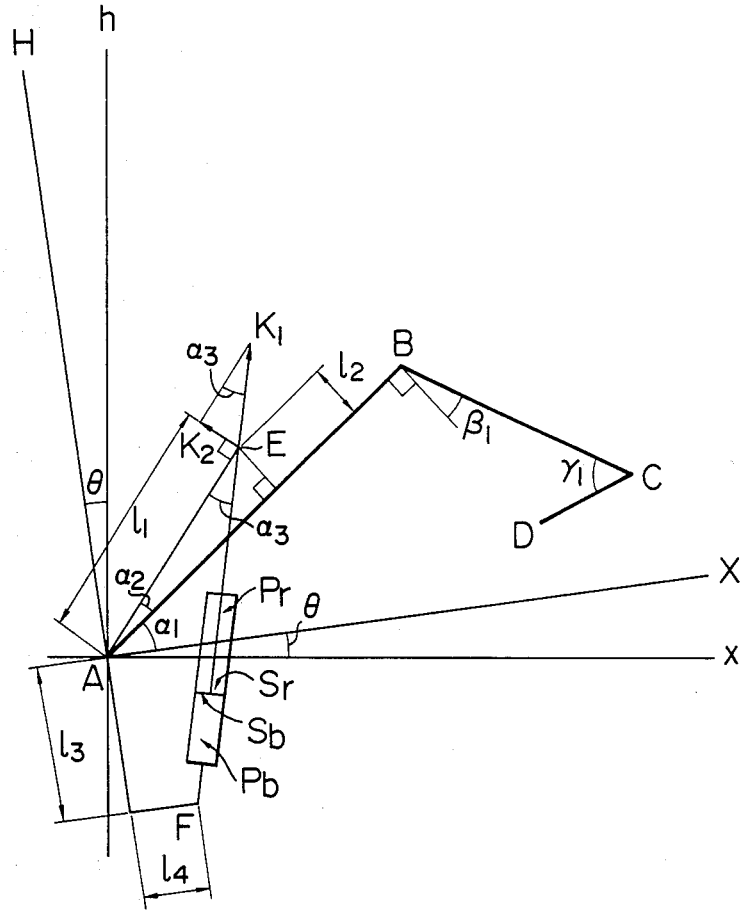
FIGS. 9, 10 and 11 are views similar to FIGS. 2, 3 and 4, respectively, in explanation of the principle of calculation of the weight of a load, with regard to a second embodiment of the invention.

In FIG. 9, h and x designate a vertical axis and a horizontal axis, respectively, centered at the pivot A of pivotal movement of the boom as viewed from the ground and constitute coordinates with the pivot A of pivotal movement of the boom serving as the origin 0 which correspond to the coordinates shown in FIG. 2. X and H designate a vertical axis and a horizontal axis, respectively, centered at the pivot A as viewed from the upper swing tilting by an angle $\theta$. As shown, the angle $\theta$ is obtained when the upper swing tilts in a direction opposite the direction in which the front attachment is located. When the upper swing tilts toward the front attachment, the angle $\theta$ of inclination is a negative angle.

In the front attachment 8 of the hydraulic excavator in this condition, the moment of rotation $M_1$ with about the pivot A due to the total weight of the front attachment 8 and the moment of rotation given by the component $K_2$ of the pressing force $K_1$ exerted by the boom cylinder balance, so that the moment $M_1$ can be expressed as follows:

$$M_1 = K_2 \times l_1 = K_1 \sin \alpha_3 \times l_1 \tag{8}$$

The angle $\alpha_3$ can be expressed as follows:

$$\alpha_3 = 90^\circ - (\alpha_1 + \alpha_2) - \tan^{-1}\left\{\frac{l_1\cos(\alpha_1 + \alpha_2) - l_4}{l_1\sin(\alpha_1 + \alpha_2) + l_3}\right\}$$

Thus, equation (8) can be rewritten as follows:

$$M_1 = K_1 \times l_1 \times \sin\left[90^\circ - (\alpha_1 + \alpha_2) - \tan^{-1}\left\{\frac{l_1\cos(\alpha_1 + \alpha_2) - l_4}{l_1\sin(\alpha_1 + \alpha_2) + l_3}\right\}\right]$$

$$= K_1 \times l_1 \cos\left[(\alpha_1 + \alpha_2) + \tan^{-1}\left\{\frac{l_1\cos(\alpha_1 + \alpha_2) - l_4}{l_1\sin(\alpha_1 + \alpha_2) + l_3}\right\}\right]$$

$$= K_1 \times l_1 \times \cos\phi$$

where $$\phi = (\alpha_1 + \alpha_2)\tan^{-1}\left\{\frac{l_1\cos(\alpha_1 + \alpha_2) - l_4}{l_1\sin(\alpha_1 + \alpha_2) + l_3}\right\}$$

The pressing force $K_1$ exerted by the boom cylinder can be expressed as follows because the boom cylinder is two in number, one mounted on one side of the front attachement and the other on the other side thereof:

$$K_1 = 2 \times (P_b \cdot S_b - P_r \cdot S_r)$$

Therefore, equation (9) can be rewritten as follows:

$$M_1 = 2(P_b \cdot S_b - P_r \cdot S_r) \times l_1 \times \cos\phi \tag{10}$$

Let the moment $M_1$ be assumed to be one obtained when the bucket 14 carries a load. It will be seen that equation (10) is identical with equation (3) and that the angle of inclination $\theta$ of the upper swing 6 has no effect on the calculation of the moment $M_1$.

Figure 10:
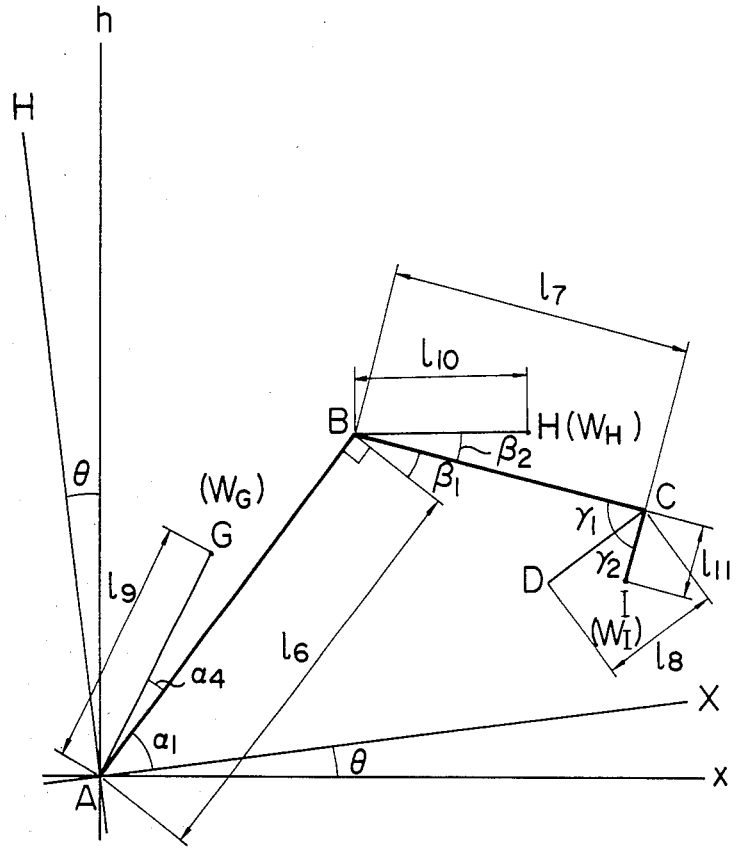

Referring to FIG. 10, let the moment of rotation $M_2$ be obtained when the front attachment 8 is in the condition shown in FIG. 9 and no load is applied to the bucket 14 (or when the bucket 14 carries no load).

A moment of rotation $M'_2$ when no load is carried by the bucket 14 can be expressed as follows like equation (4):

$$M'_2 = W_G \cdot l_9\cos(\theta + \alpha_1 + \alpha_4) + W_H \cdot \{l_6\cos(\theta + \alpha_1) + l_{10}\sin(\theta + \alpha_1 + \beta_1 + \beta_2)\} + W_J \cdot \{l_6\cos(\theta + \alpha_1) + l_7\sin(\theta + \alpha_1 + \beta_1) - l_{11}\sin(\theta + \alpha_1 + \beta_1 + \gamma_1 + \gamma_2) \tag{11}$$

Equation (10) shows a moment of rotation about the pivot A when the bucket 14 carries a load, and equation (11) shows a moment of rotation about the pivot A when the bucket 14 carries no load, so that a moment of rotation $M'_3$ about the pivot A produced by the load of the bucket 14 itself is obtained by the following equation:

$$M'_3 = M_1 - M'_2 \tag{12}$$

Figure 11:
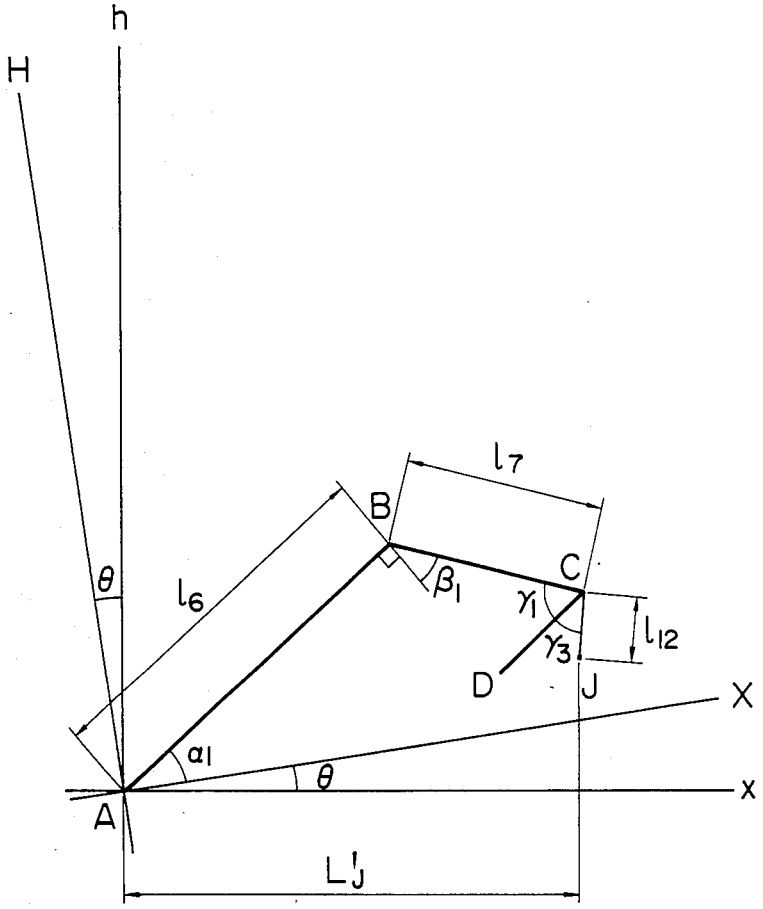

To obtain a weight $W_J$ of the load of the bucket 14, a horizontal distance $L'_J$ between a position of the center of gravity J of the load and the pivot A is obtained by referring to FIG. 11. The distance $L'_J$ can be expressed by the following equation like equation (6):

$$L'_J = l_6\cos(\theta + \alpha_1) + l_7\sin(\theta + \alpha_1 + \beta_1) - l_{12}\sin(\theta + \alpha_1 + \beta_1 + \gamma_1 + \gamma_3) \tag{13}$$

The weight $W_J$ of the load carried by the bucket 14 can be expressed by the following equation:

$$W_J = M'_3 / L'_J \tag{14}$$

The embodiment of the invention based on the aforesaid principle of calculating the load will now be described.

Figure 12:
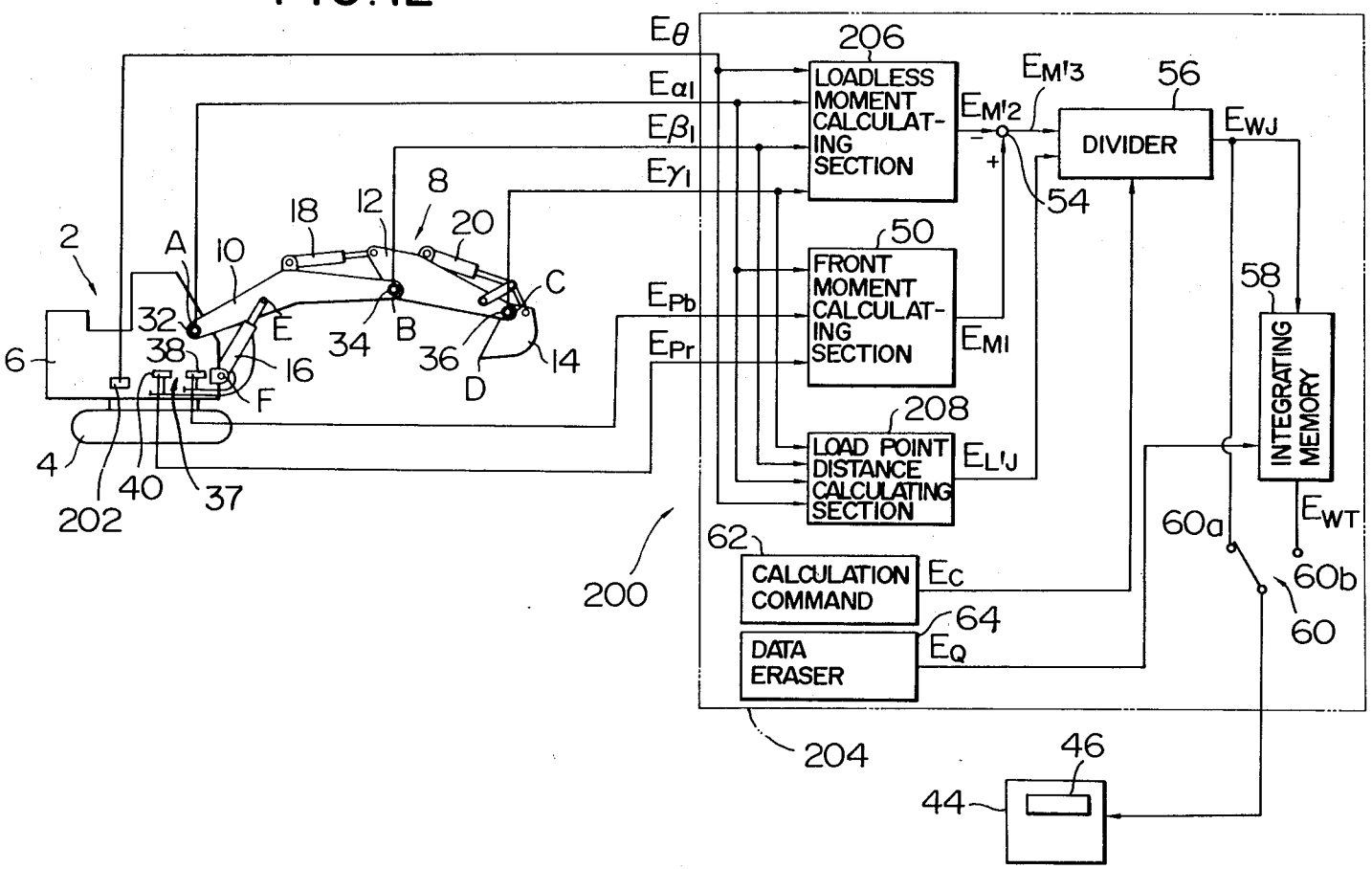
FIG. 12 is a block diagram of the load weight indicating system comprising the second embodiment.

In FIG. 12, a load weight indicating system for the hydraulic excavator 2 comprising the second embodiment is generally designated by the reference numeral 200, and parts similar to those of the first embodiment shown in FIG. 5 are designated by like reference characters.

The system 200 comprises, in addition to the angle detectors 32, 34 and 36 and pressure sensors 38 and 40, a tilting angle detector 202 for the upper swing 6 for producing a signal $E_\theta$ which corresponds to the tilting angle $\theta$ of the upper swing 6, and a load weight calculating unit 204 comprising a loadless moment calculating section 206 having inputted thereto signals $E_{\alpha 1}$, $E_{\beta 1}$, $E_{\gamma 1}$ and $E_\theta$ and operative to perform calculation thereon to obtain the moment $M'_2$ of rotation and output a signal $E_{M'2}$ indicative of the moment $M'_2$, and a load point distance calculating section 208 having inputted thereto the signals $E_{\alpha 1}$, $E_{\beta 1}$, $E_{\gamma 1}$ and $E_\theta$ and operative to perform calculation thereon to obtain the horizontal distance $L'_J$ and output a signal $M_{L'J}$ indicative of the horizontal distance $L'_J$. Other parts of the system 200 are similar to those of the system 30 shown in FIG. 5, so that their description will be omitted.

Figure 13:
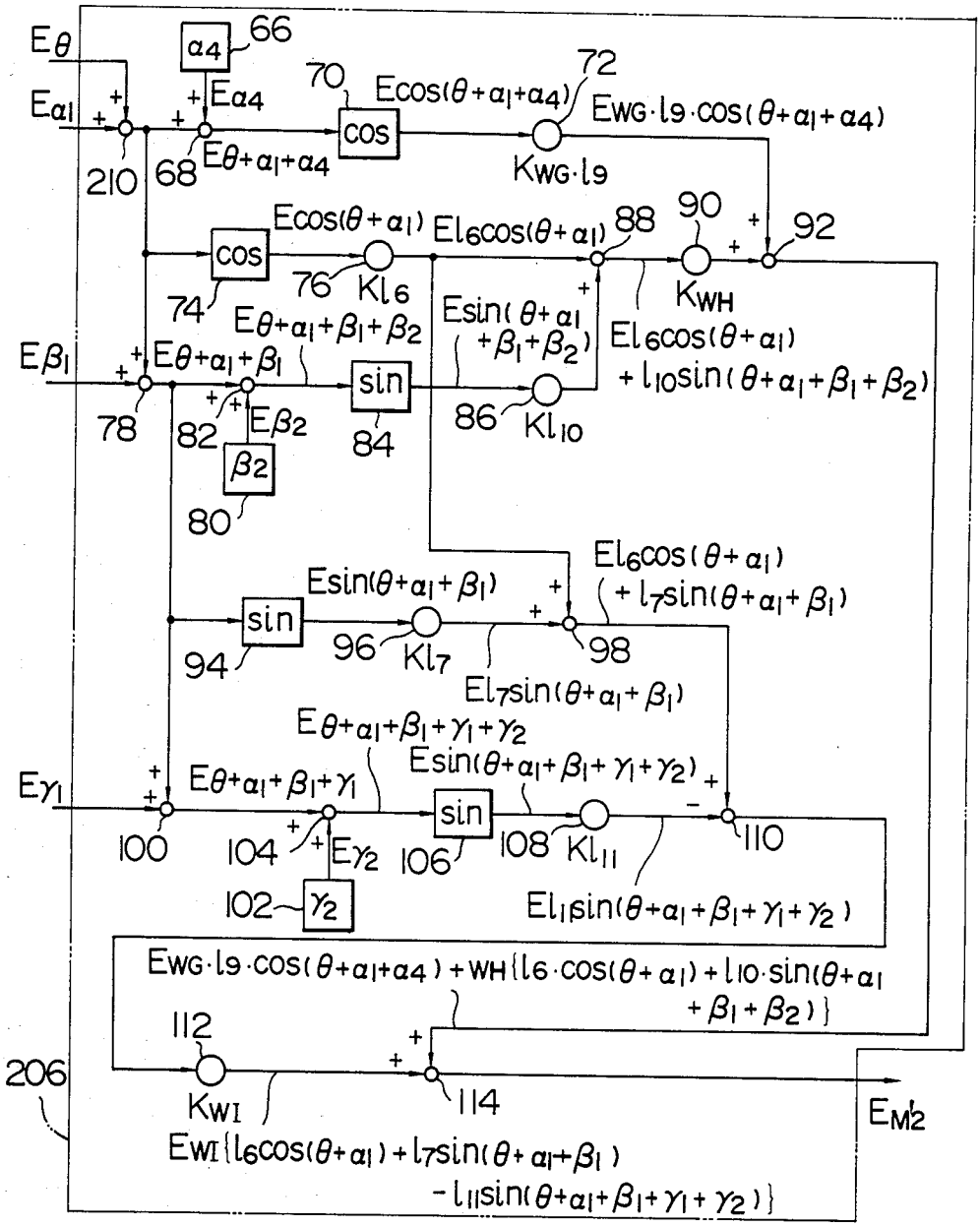
FIGS. 13 and 14 are block diagrams showing the constructions of the loadless moment calculating section and the load point distance calculating section, respectively, shown in FIG. 12.

As shown in FIG. 13, the loadless moment calculating section 206 comprises an adder 210 for adding a boom angle signal $E_{\alpha 1}$ supplied from the angle detector 32 and a tilt signal E supplied from the tilting angle detector 202 together and producing a signal $E_{\theta+\alpha 1}$. The construction and operation of other parts are similar to those of the calculating section 48 shown in FIG. 6. Thus, the loadless moment calculating section 206 finally outputs the signal $E_{M'2}$ corresponding to the loadless momenr $M'_2$ shown in equation (11).

Figure 14:
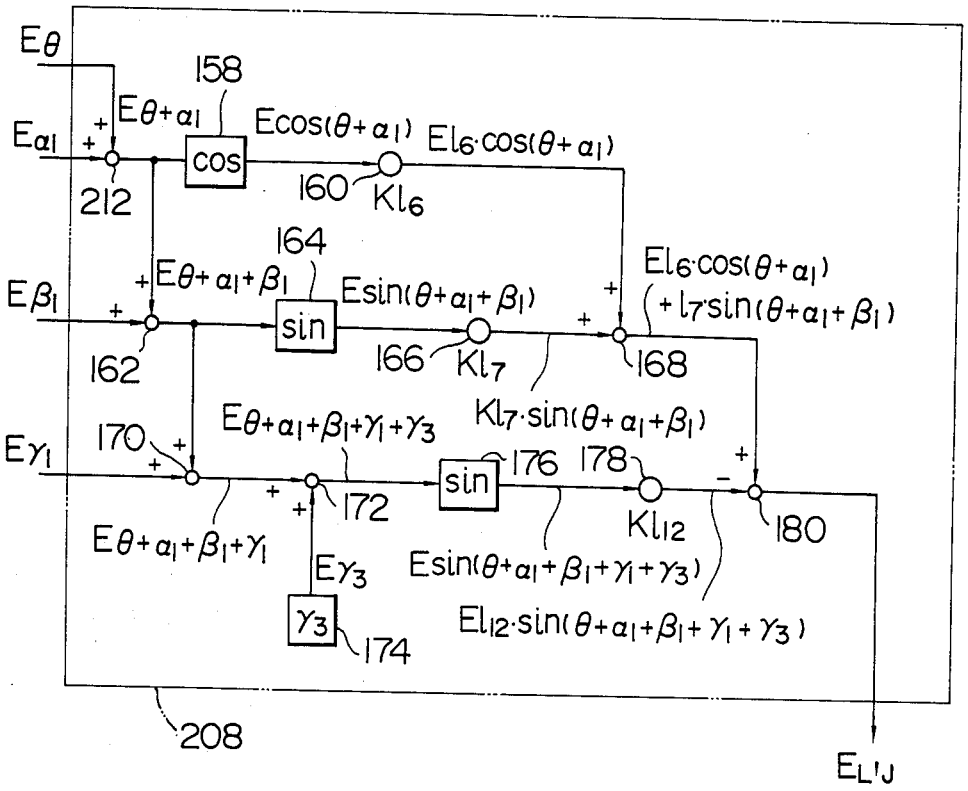

As shown in FIG. 14, the load point distance calculator 208 comprises an adder 212 for adding the tilting angle signal $E_\theta$ and the boom angle signal $E_{\alpha 1}$ together and producing a signal $E_{\theta+\alpha 1}$. The construction and operation of other parts are similar to those of the calculator 52 shown in FIG. 8. Thus, the load point distance calculating section 208 finally produces the signal $E_{L'J}$ corresponding to the horizontal distance $L'_J$ shown in equation (13).

Thus, in the embodiment shown and described hereinabove, the angle detector 202 for detecting the tilting angle $\theta$ of the upper swing 6 is additionally provided to enable calculation of the weight of a load to be performed by taking into consideration the tilting angle $\theta$ detected by the angle detector 202, so that it is possible to determine the weight of the angle which is not influenced by the tilting of the upper swing 6.

The principle of calculation of the weight of a load according to a third embodiment of the invention will be described by referring to FIGS. 2 and 4.

In the first and second embodiments, moments were obtained by calculation based on structural weights of the front attachment 8 as loadless moments $M_2$ and $M'_2$ necessary for obtaining the weight of a load. In actual operation conditions, however, operation would have to be carried out while mud sticks to the bucket. Also, the structural weights of the front attachment 8 might have production errors. When this is the case, it would be impossible to obtain accurate information on the weight of the load by calculating the moments based on the structural weights. The third embodiment provides means for avoiding such disadvantage.

Referring to FIG. 2, the moment of rotation $M_1$ about the pivot A due to the total weight of the front attachment 8 of the hydraulic excavator and the moment of rotation about the pivot A given by the component $K_2$ of the pressing force $K_1$ exerted by the boom cylinder balance, so that the moment $M_1$ can be expressed as follows as aforesaid:

$$M_1 = 2\,(P_b \cdot S_b - P_r \cdot S_r) \times l_1 \times \cos\phi \tag{3}$$

where $$\phi = (\alpha_1 + \alpha_2) + \tan^{-1}\left\{\frac{l_1\cos(\alpha_1 + \alpha_2) - l_4}{l_1\sin(\alpha_1 + \alpha_2) + l_3}\right\}$$

The moment $M_1$ represents a value produced by the total weight of the front attachment including the weight of a load when there is one in the bucket, and the moment $M_1$ also represent a value produced by the total weight of the front attachment only when there is no load in the bucket.

To obtain the weight of a load in the bucket, it would be necessary to divide a moment of rotation about the pivot A due to the weight of the load itself by the horizontal distance between the pivot A and the position of the center of gravity of the load. The moment due to the weight of the load itself can be obtained by subtracting the moment obtained by equation (3) when there is no load (loadless moment which will be denoted by $M_0$) from the moment $M_1$ obtained by equation (3) when there is a load. However, the moments would naturally vary depending on the position (posture) of the front attachment. Thus, to subtract moment $M_0$ from moment $M_1$, it would be necessary that the front attachment be of the same posture when the moments $M_1$ and $M_0$ are obtained. However, no such condition would exist at the same time that the same bucket would carry a load on one hand and would not carry one on the other hand.

However, when one considers the aforesaid operation of loading a dump truck with sand by means of a hydraulic excavator, it will be apparent that the operation consists of a multiplicity of similar bucket operations for loading the sand and it will be noted that the front attachment assumes substantially the same posture for an instant each time the bucket operation is performed. Meanwhile, the weight of a load carried by a bucket is constant during one bucket operation, so that it would not be necessary to perform the aforesaid subtraction at all times as the front attachment moves. From this point of view, it would be possible to set a certain position (posture) for the front attachment to assume during a loading operation, and obtain moments $M_1$ and $M_0$ separately from each other when the front attachment is in this position, and to perform the aforesaid subtraction based on the obtained values of moments $M_1$ and $M_0$, to thereby obtain the weight of the load. More specifically, if the front attachment were assumed to be in a set position when the bucket is vacant and the loadless moment $M_0$ were obtained by equation (3) when the front attachment is in said set position and suitably stored in the memory, then one would only have to perform the aforesaid subtraction by obtaining the moment $M_1$ each time the front attachment assumes the set position during a loading operation subsequently to be performed.

Referring to FIG. 4, the horizontal distance $L_J$ between the pivot A and the position of the center of gravity of the load can be expressed by the following equation:

$$L_J = l_6 \cos\alpha_1 + l_7 \sin(\alpha_1 + \beta_2) - l_{12} \sin(\alpha_1 + \beta_2 + \gamma_1 + \gamma_3) \tag{6}$$

The weight of the bucket $W_J$ can be expressed by the following equation:

$$W_J = \frac{M_1 - M_0}{L_J} \tag{15}$$

The embodiment of the invention based on the aforesaid principle of calculation will now be described.

Figure 15:
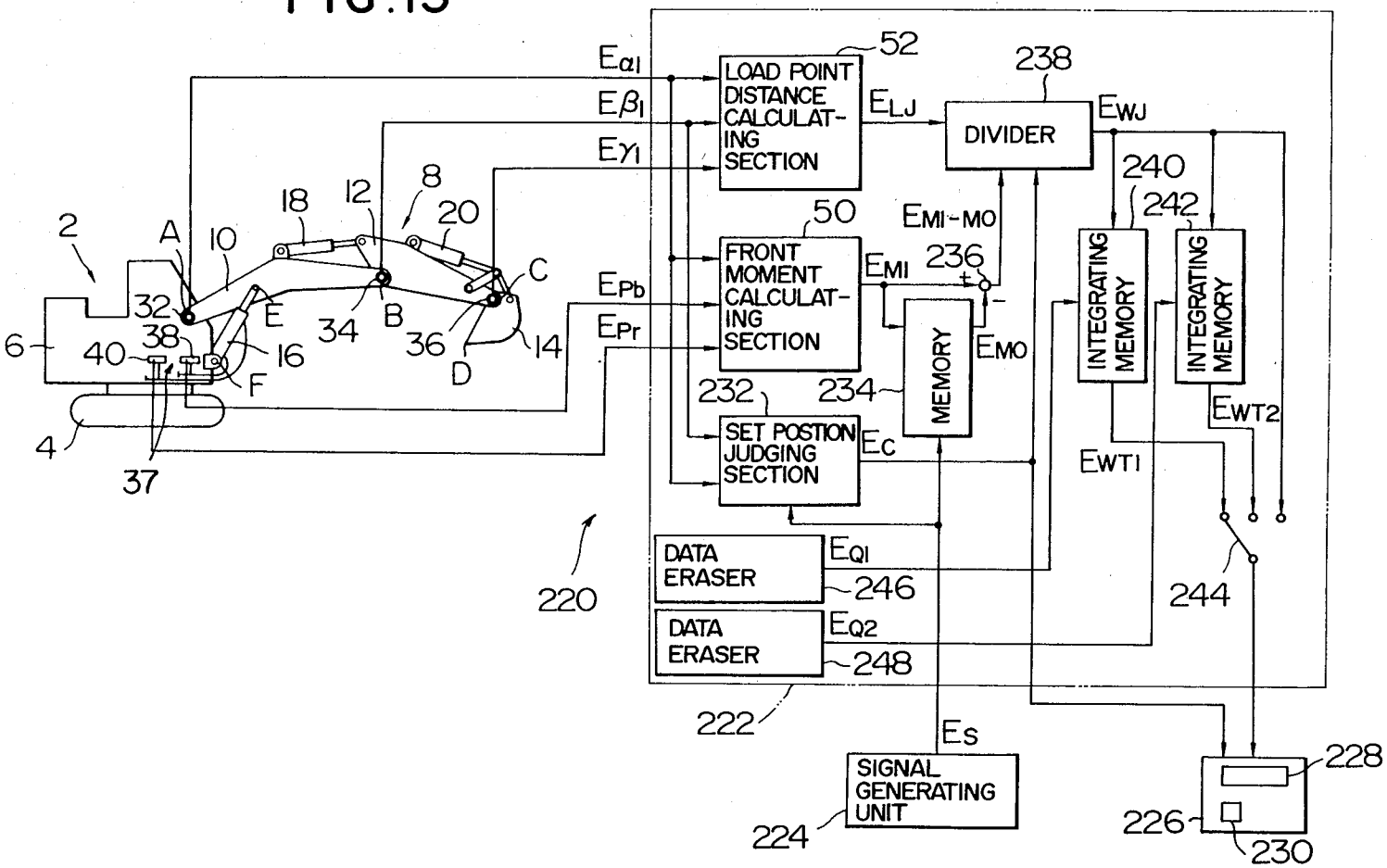
FIG. 15 is a block diagram of the load weight indicating section comprising a third embodiment.

Referring to FIG. 15, a load weight indicating system for the hydraulic excavator 2 of this embodiment is generally designated by the reference numeral 220 and parts thereof similar to those of the embodiment shown in FIG. 5 are designated by like reference characters.

Like the system 30 shown in FIG. 5, the system 220 comprises angle detectors 32, 34 and 36 a pressing force sensor 37 including and pressure sensors 38 and 40. The system 220 further comprises a calculating unit 222 for calculating the weight of a load, a signal generating unit 224 for indicating the setting of a position for obtaining the loadless moment $M_0$ and an indicating unit 226 actuated by a signal outputted by the calculating unit 220 for indicating the weight of the load. The indicating unit 226 includes a value indicating surface 228, and a buzzer 230 for sounding the value indicated on the indicating surface 228.

The set position signal generating unit 224 will be described in detail. Prior to initiation of a sand loading operation, the operator of a hydraulic excavator performs the same bucket operation with the bucket in a vacant condition as would subsequently to be performed. When the front attachment comes to a suitable position, the signal generating unit 224 is actuated as by depressing a button. As a result, the signal generating unit 224 produces a signal $E_s$ so that the value of the loadless moment $M_0$ and the position of the front attachment 8 are stored. In the embodiment shown and described hereinabove, the set position of the front attachment 8 is governed by the boom angle $\alpha_1$ and arm angle $\beta_1$ obtained at that time.

The calculating unit 222 is constructed as follows as shown in FIG. 15. More specifically, it comprises a load point distance calculating section 52 having inputted thereto signals $E_{\alpha 1}$, $E\beta_1$ and $E_{\gamma 1}$ corresponding to the signals $\alpha_1$, $\beta_2$ and $\gamma_1$, respectively, and operative to calculate the horizontal distance $L_J$ and output a signal $E_{LJ}$ corresponding to the horizontal distance $L_J$, and a front moment calculating section 50 having inputted thereto the signal $E_{\alpha 1}$ and signals $E_{Pb}$ and $E_{pr}$ corresponding to the pressures Pb and Pr respectively, and operative to calculate the moment $M_1$ and output a signal $E_{M1}$ corresponding to the moment $M_1$. The calculating unit 222 further comprises a set position judging section 232 having the signals $E_{\alpha 1}$ and $E_{\beta 1}$ inputted thereto and operative to store the signals $E_{\alpha 1}$ and $E_{\beta 1}$ inputted thereto at the time the signal $E_s$ is inputted thereto from the set position signal generating unit 224 while operative to compare with the stored signals the signals $E_{\alpha 1}$ and $E_{\beta 1}$ inputted thereto while showing variations in value with the movement of the front attachment 8 and generate a calculation command signal $E_c$ when the signals $E_{\alpha 1}$ and $E_{\beta 1}$ become substantially equal in value to the stored signals, and a memory 234 having inputted thereto the front moment signals $E_{M1}$ from the front moment calculating section 50 and operative to store the front moment signal $E_{M1}$ inputted thereto at the time the signal $E_s$ is inputted thereto from the signal generating unit 224. As described hereinabove, the front moment obtained at this time is a loadless moment $M_0$, so that the signal stored in the memory 234 represents a loadless moment signal $E_{M0}$ corresponding to the loadless moment $M_0$ and the loadless moment signal $E_{M0}$ is outputted thereafter from the memory 235. The calculating unit 222 further comprises a subtractor 236 for subtracting the signal $E_{M0}$ of the memory 234 from the signal $E_{M1}$ of the front moment calculating section 50 and outputting a signal $E_{M1-M0}$, and a divider 238 for dividing the signal $E_{M1-M0}$ of the subtractor 236 by the signal $E_{LJ}$ of the load point distance calculating section 52 and outputting a signal $E_{WJ}$ corresponding to the weight of the load $W_J$. The signal $E_{WJ}$ is forwarded to integrating memories 240 and 242 and an indication switch 244. The integrating memory 240 is used as a memory for storing the integrated weight of a load placed on one dump truck, for example, and the integrating memory 242 is used as a memory for storing the integrated weight of a load handled over a predetermined period of time, such as one day, one week, one month, etc. The data stored in the memories 240 and 242 are erased by data eraser switches 246 and 248, respectively. The indication switch 244 has terminals connected to the divider 238 and integrating memories 240 and 242 and performs the function of switching the indications given in the indicating unit 226 to give a proper indication.

Figure 7:
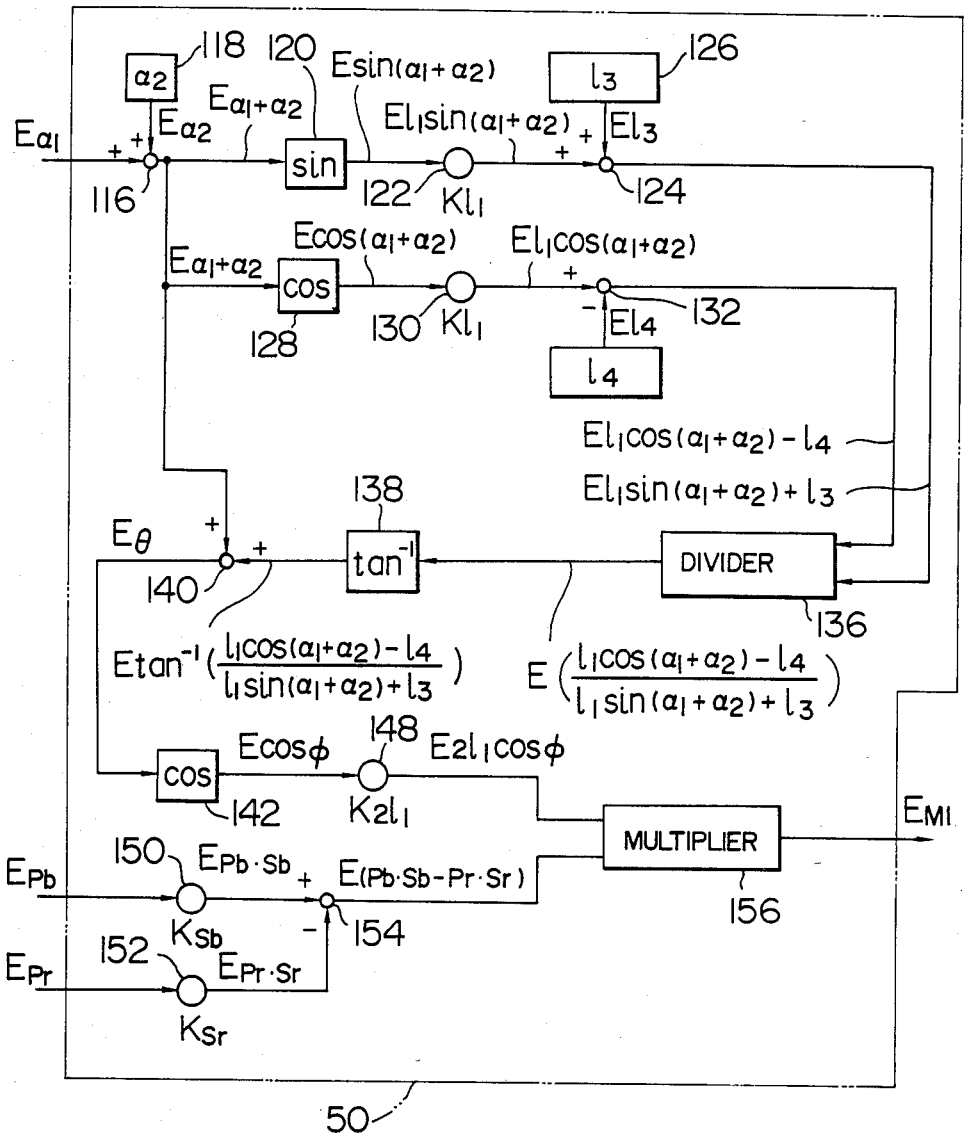
Figure 8:
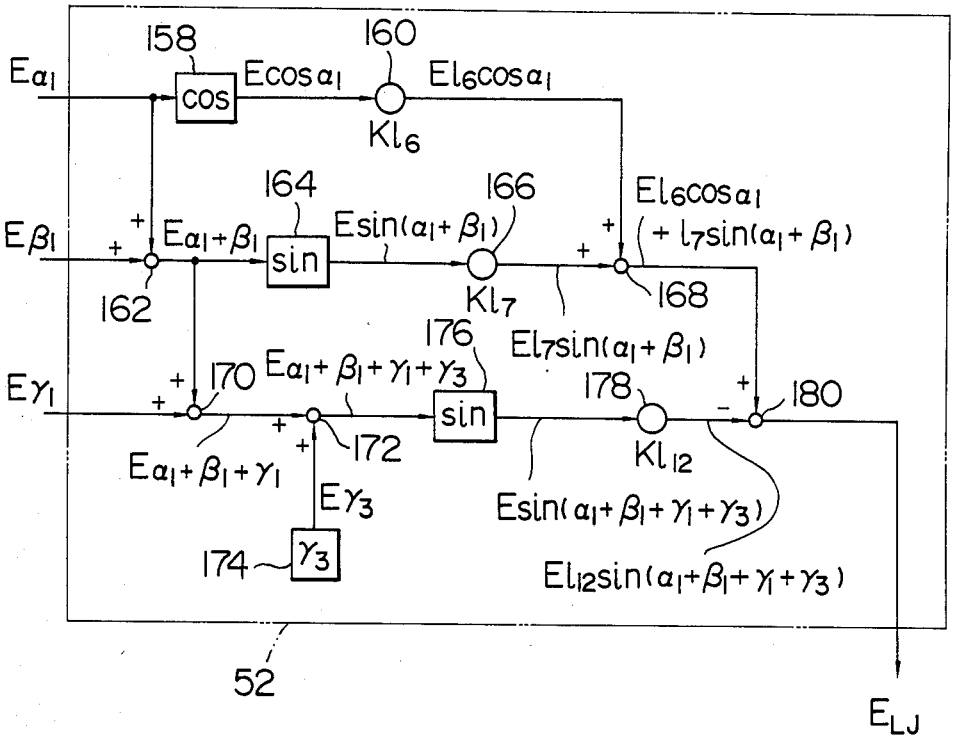

The constructions and operations of the front moment calculating section 50 and load point distance calculating section 52 are as described by referring to FIGS. 7 and 8 with respect to the embodiment shown in FIG. 5.

Figure 16:
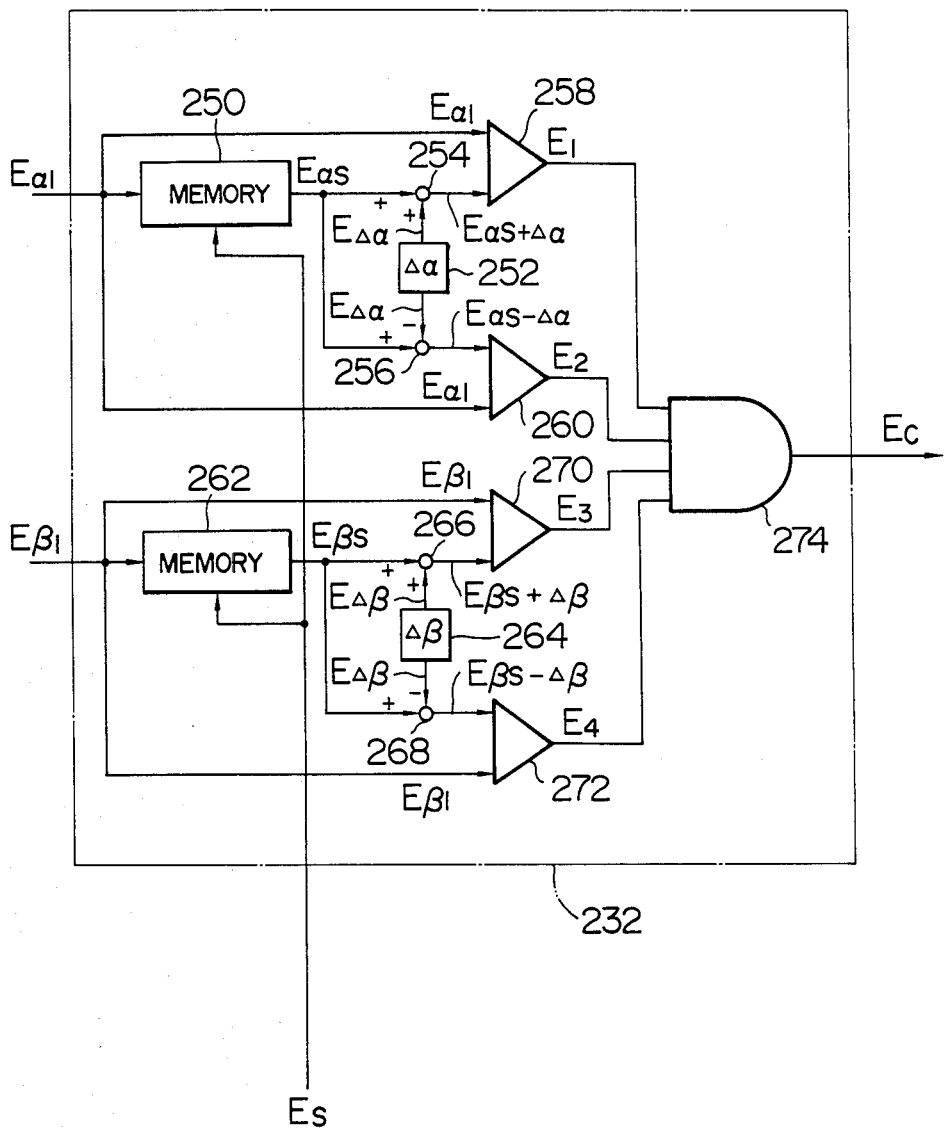
FIG. 16 is a block diagram showing the construction of the set position judging section shown in FIG. 15.

The construction and operation of the set position judging section 232 will be described by referring to FIG. 16. The boom angle signals $E_{\alpha 1}$ are inputted at all times to a memory 250 which stores the boom angle signal $E_{\alpha 1}$ inputted thereto at the time the signal $E_s$ is inputted thereto from the signal generating unit 224. The boom angle signal $E_{\alpha 1}$ stored at this time defines the set position of the boom and is to be referred hereinafter as a signal $E_{\alpha s}$. The numeral 252 is a memory having stored therein a suitably selected value $\Delta\alpha$ and outputs a signal $E_{\Delta\alpha}$ corresponding to this value $\Delta\alpha$. This embodiment is constructed such that calculation of the weight of a load is performed only when the front attachment 8 passes by the set position during operation. However, it does not necessarily follow that the front attachment will accurately pass by the set position each time a bucket operation is performed during a loading operation. Thus, the trouble that calculation of the weight of a load is not performed would occur. The provision of the constant $\Delta\alpha$ obviates the aforesaid trouble. That is, when the boom angle is in the range between the boom angle $\alpha_s$ and $\alpha_s \pm \Delta\alpha$, any boom angle is regarded as being the boom angle $\alpha_s$ as defined. Thus, the signal $E_{\Delta\alpha}$ is added to the signal $E\alpha_s$ at an adder 254 which outputs a signal $E_{\alpha s+\Delta\alpha}$ corresponding to a boom angle $(\alpha_s+\Delta\alpha)$. Meanwhile, a subtracter 256 produces a signal $E_{\alpha s-\Delta\alpha}$ correspondint to a boom angle $(\alpha_s-\Delta\alpha)$. The signal $E_{\alpha s+\Delta\alpha}$ is compared with the boom angle signals $E_{\alpha 1}$ at a comparator 358 which produces a signal $E_1$ of high level when $E_{\alpha 1} \leqq E_{\alpha s+\Delta\alpha}$. The signal $E_{\alpha s-\Delta\alpha}$ is compared with the signals $E_{\alpha 1}$ at a comparator 260 which produces a signal $E_2$ of high level when $E_{\alpha 1} \geqq E_{\alpha s-\Delta\alpha}$. The arm angles may be handled based on the same concept as described hereinabove by referring to the boom angles. That is, the arm angle signals $E_{\beta 1}$ are inputted to memory 262 which stores the signal $E_{\beta 1}$ inputted thereto when the signal $E_s$ is inputted thereto. A memory 264 stores therein a constant $\Delta\beta$ of the same kind as the constand $\Delta\alpha$ stored in the memory 252. An adder 266 outputs a signal $E_{\alpha s+\Delta\beta}$ which represents the sum of the signals $E_{\beta s}$ and $E_{\Delta\beta}$, and a subtracter 268 outputs a signal $E_{\beta s-\Delta\beta}$ representing the difference between the signals $E_{\beta s}$ and $E_{\Delta\beta}$. The signal $E_{\beta s+\Delta\beta}$ is compared with the signal E at a comparator 270 which outputs a signal $E_3$ of high level when $E_{\beta 1} \leqq E_{\beta 1+\Delta\beta}$, and the signal $E_{\beta s-\Delta\beta}$ is compared with the signal $E_{\beta 1}$ at a comparator 272 which produces a signal $E_4$ of high level when $E_{\beta 1} \geqq E_{\beta 1-\Delta\beta}$. The signals $E_1$, $E_2$, $E_3$, and $E_4$ are inputted to an AND gate 274 which produces the signal $E_c$ only when all the signals $E_1-E_4$ are simultaneously inputted thereto. To sum up, the set position judging section 232 judges that the front attachment 8 is located in the set position only when the following relation holds and producers the signal $E_c$ for giving a command to perform calculation of the weight of load:

$$\left.\begin{array}{l} |\alpha_1 - \alpha_s| \leqq \Delta\alpha \\ |\beta_1 - \beta_s| \leqq \Delta\beta \end{array}\right\} \quad (16)$$

As described hereinabove, prior to initiation of a sand loading operation, the operator actuates the front attachment to perform operation with no load in the same manner as operations are subsequently to be performed repeatedly, and actuates the signal generating unit 224 when the front attachment assumes a certain position, so that the signal generating unit 224 produces the signal $E_s$ at this time and causes the memory 234 to store a signal $E_{M0}$ corresponding to the loadless moment $M_0$ and at the same time sets signals $E_{\alpha s}$ and $E_{\beta s}$ in the set position judging section 232. Then, as the sand loading operation is initiated, the calculation command signal $E_c$ is supplied from the set position judging section 232 to the subtracter 238 each time the front attachment reaches the set position, and calculation is performed on $E_{M1-M0}/E_{LJ}$ in accordance with equation (15) at the subtracter 238. Thus, a signal $E_{WJ}$ corresponding to the weight of the load $W_J$ is obtained. By actuating the indication switch 244, the operator gives indication of the weight of a load for each bucket operation, the weight of a load on a dump truck or the total weight of loads handled for a predetermined period of time in the indicating unit 226 by means of signals $E_{WJ}$, $E_{WT1}$ or $E_{WT2}$. Each time the signal $E_c$ is produced, a buzzer 230 of the indicating unit 226 is actuated to produce a buzzing sound to thereby inform the operator of giving an indication or making an alteration in the indication. Upon completion of the operation of loading a dump truck with sand or of integration of values for a predetermined period of time, the data eraser switches 246 and 248 are actuated to produce signals $E_{Q1}$ and $E_{Q2}$ to erase the data stored in the integrating memories 240 and 242, and make the system stand by for the next operation.

From the foregoing description, it will be appreciated that according to the invention, a moment due to the front attachment itself is obtained with no load in the bucket prior to initiation of sand loading operation and used as a loadless moment which is used for calculating the weight of a load in subsequent operations. This is conducive to increased accuracy in the value obtained when the weight of a load is determined.

A fourth embodiment in which another process is used to calculate a loadless moment due to the weight of the front attachment itself with no load in the bucket prior to initiation of a sand loading operation will be described.

As described by referring to FIG. 3 with regard to the embodiment shown in FIG. 5, a loadless moment $M_2$ due to the structural weight of the front attachment can be expressed by the following equation:

$$M_2 = W_G \cdot l_9\cos(\alpha_1 + \alpha_4) + W_H \cdot \{l_6\cos\alpha_1 + l_{10}\sin(\alpha_1 + \beta_1 + \beta_2)\} + W_I \cdot \{l_6\cos\alpha_1 + l_7\sin(\alpha_1 + \beta_1) - l_{11}\sin(\alpha_1 + \beta_2 + \gamma_1 + \gamma_2)\} \quad (4)$$

The loadless moment $M_2$ would actually be distinct in value from the loadless moment $M_0$ obtained by the equation (3) because of production errors or due to the adhesion of sand to the bucket. This embodiment is characterized in that the value of the loadless moment $M_2$ obtained by calculation is corrected when there is any difference between it and the actual loadless moment $M_0$. As means for effecting correction of the loadless moment $M_2$, the process relying on the correction of the weight $W_I$ of the bucket influencing greatly the weight of the front attachment will be described. Assume that the difference between the loadless moments $M_0$ and $M_2$ stems from the difference in weight between the buckets. The difference $\Delta W_I$ between the buckets in weight can be obtained by the following equation:

$$\Delta W_I = (M_0 - M_2)/L_I \quad (17)$$

$L_I$ is, as shown in FIG. 3, the horizontal distance between the pivot A and the position I of the center of gravity of the bucket and calculated as follows:

$$L_I = l_6\cos\alpha_1 + l_7\sin(\alpha_1 + \beta_1) - l_{11}\sin(\alpha_1 + \beta_1 + \gamma_1 + \gamma_2)$$

By correcting the weight of the bucket $W_I$ by using the value $\Delta W_I$, the corrected weight of the bucket can be obtained as $W_I + \Delta W_I$. By substituting the corrected weight of the bucket $W_I + \Delta W_I$ into equation (4), a corrected loadless moment $M_{20}$ can be obtained by the following equation:

$$M_{20} = W_G \cdot l_9\cos(\alpha_1 + \alpha_4) + W_H \cdot \{l_6\cos\alpha_1 + l_{10}\sin(\alpha_1 + \beta_1 + \beta_2)\} + (W_I + \Delta W_I) \cdot \{l_6\cos\alpha_1 + l_7\sin(\alpha_1 + \beta_1) - l_{11}\sin(\alpha_1 + \beta_1 + \gamma_1 + \gamma_2)\} \quad (18)$$

A fourth embodiment based on the theory of calculation described hereinabove will be described.

Figure 17:
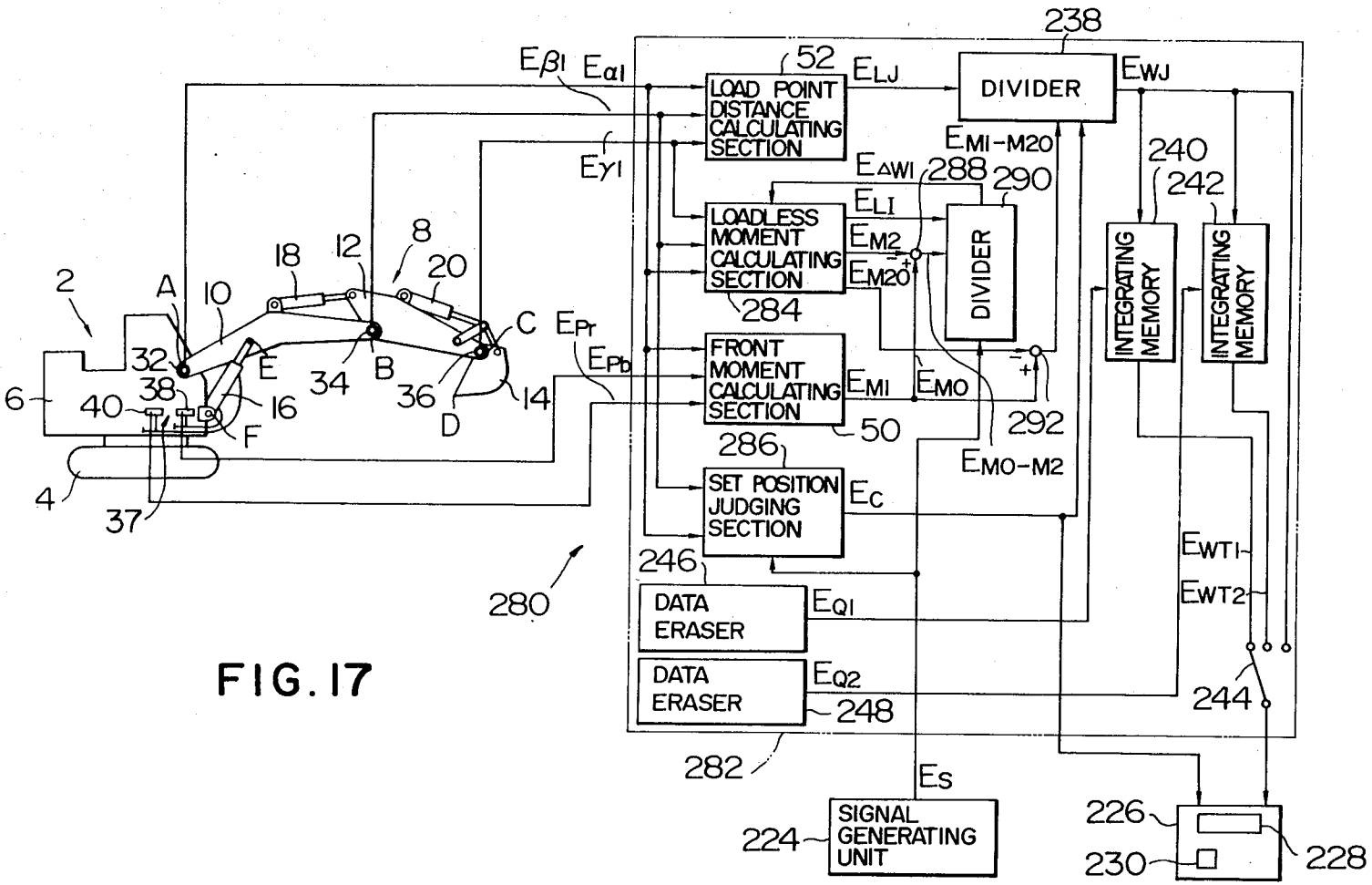
FIG. 17 is a block diagram of a load weight indicating system comprising a fourth embodiment.

In FIG. 17, a load weight weight calculating system for the hydraulic excavator 2 comprising this embodiment is generally designated by the reference numeral 280 in which parts similar to those of the embodiment shown in FIG. 15 are designated by like reference characters.

The system 280 comprises a load weight calculating unit 282 comprising, like the calculating unit 220 shown in FIG. 15, a load point distance calculating section 52, and a front moment calculating section 50. The system 282 further comprises a loadless moment calculating section 284, and a set position judging section 286. The section 284 has inputted thereto the signals $E_{\alpha 1}$, $E_{\beta 1}$ and $E_{\gamma 1}$ and a correction signal $E_{\Delta W1}$ subsequently to be described and is operative to calculate the horizontal distance $L_I$, loadless moment $M_2$ and corrected loadless moment $M_{20}$ and output signals $E_{LI}$, $E_{M2}$ and $E_{M20}$ representing the $L_I$, $M_2$ and $M_{20}$, respectively. The section 286 has inputted thereto the signals $E_{\alpha 1}$ and $E_{\beta 1}$ and operative to store a position signal $E_{HO}$ calculated from the signals $E_{\alpha 1}$ and $E_{\beta 1}$ inputted thereto at the time the signal $E_s$ is inputted thereof from the signal generating unit 224, compare the stored signal with a position signal $E_H$ calculated from the signals $E_{\alpha 1}$ and $E_{\beta 1}$ inputted thereto while varying their values as the front attachment moves and produce a calculation command signal $E_c$ when the signals $E_H$ and $E_{HO}$ become substantially equal to each other. At a subtracter 288, subtraction is performed on a signal $E_{M2}$ from the loadless moment calculating section 284 and a signal $E_{M0}$ which is an output of the front moment calculating section 50 produced when the bucket 14 carrier no load, and a signal $E_{M0}-M2$ is produced which, together with a signal $E_{LI}$ from the loadless moment calculating section 284, is sent to a divider 290 which performs division of $E_{M0-M2}$ by $E_{LI}$ when the signal $E_s$ is inputted thereto and output a correction signal $E_{\Delta WI}$.

Subtraction is performed on the signal $E_{M20}$ from the loadless moment calculating section 284 and the signal $E_{M1}$ from the front moment calculating section 50 at a subtracter 292 which outputs a signal $E_{M1-M20}$ to the divider 238 which produces a signal $E_{WJ}$ indicating the weight of the load.

Figure 18:
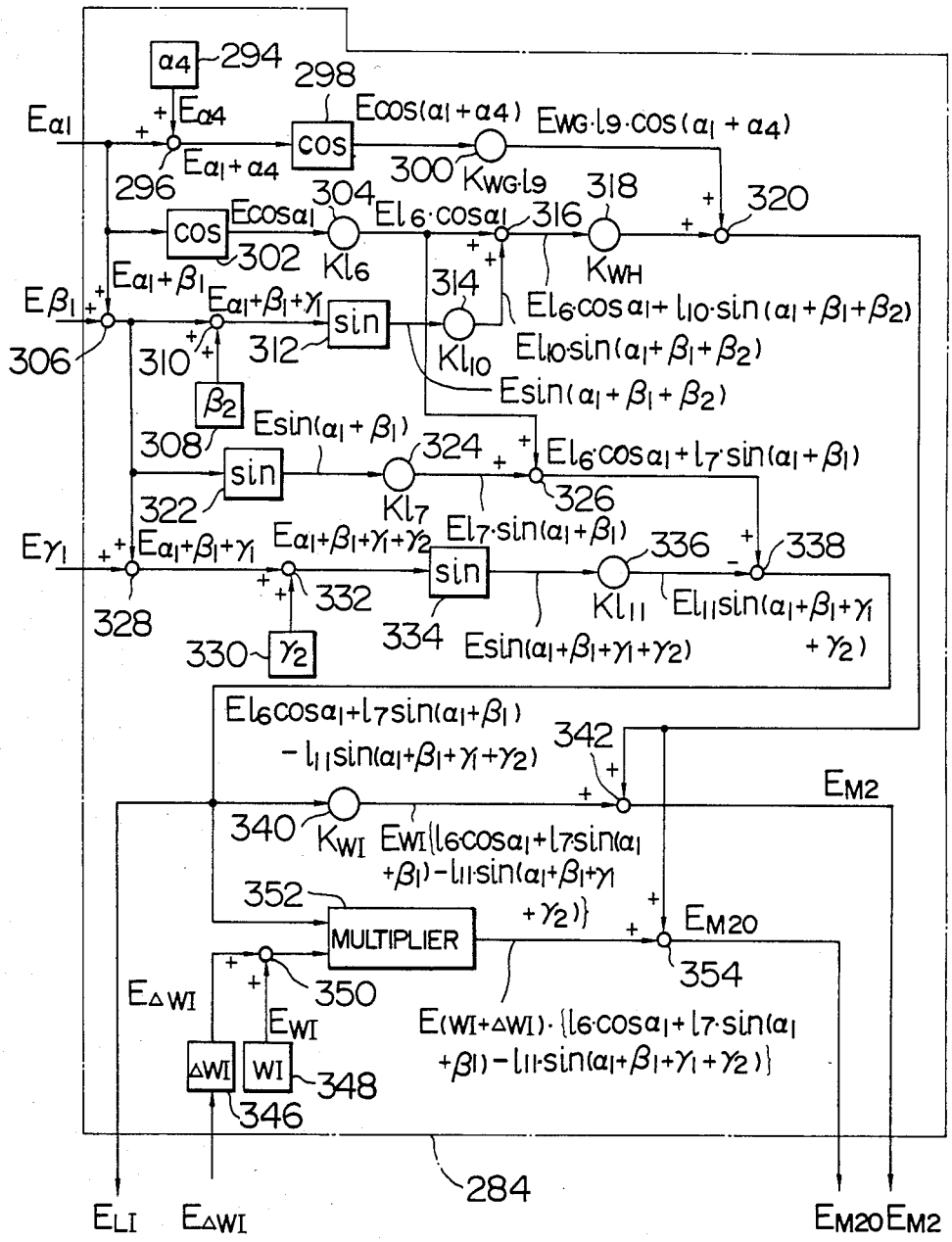
FIGS. 18 and 19 are block diagrams showing the constructions of the loadless moment calculating section and the set point judging section, respectively, shown in FIG. 17.

The construction and operation of the loadless moment calculating section 284 will be described by referring to FIG. 18. The boom angle signal $E_{\alpha 1}$ from the angle detector 32 and the signal $E_{\alpha 4}$ of an angle $\alpha_4$ stored in a memory 294 are added to each other at an adder 296 which produces a signal $E_{\alpha 1+\alpha 4}$ which is inputted to a trigonometric function generator 298 from which a signal $E_{\cos(\alpha 1+\alpha 4)}$ corresponding to the cosine of the angle $(\alpha_1+\alpha_4)$ is taken out. At a coefficient generator 300, the signal $E_{cos(\alpha 1+\alpha 4)}$ is multiplied by a signal corresponding to the value obtained by multiplying the weight $W_G$ by the distance $l_9$ to produce a signal $E_{WG \cdot l9 \cdot cos(\alpha 1+\alpha 4)}$. Meanwhile, the boom signal $E_{60\ 1}$ is inputted to a trigonometric function generator 302 from which a signal $E_{cos\ \alpha 1}$ corresponding to the cosine of the angle $\alpha_1$ is taken out and multiplied by a signal corresponding to the distance $l_6$ at a coefficient generator 304 59 produce a signal $E_{l6\ cos\ \alpha 1}$. The arm angle angle $E_{\beta 1}$ and boom angle $E_{\alpha 1}$ are added together at an adder 306 to produce a signal $E_{\alpha 1+\beta 1}$ which is added to a signal $E_{\beta 2}$ corresponding to the angle $\beta_2$ stored in a memory 308 at an adder 310 to produce a signal $E_{\alpha 1+\beta 1+\beta 2}$. This signal is inputted to a trigonometric function generator 312 from which a signal $E_{sin(\alpha 1+\beta 1+\beta 2)}$ corresponding to the sine of an angle $(\alpha_1+\beta_1+\beta_2)$ is taken out and multiplied by a signal corresponding to the distance $l_{10}$ at a coefficient generator 314 to produce a signal $E_{l10\ sin(\alpha 1+\beta 1+\beta 2)}$. This signal is added to the signal $E_{l6\ cos\ \alpha 1}$ at an adder 316 and multiplied by a signal corresponding to the weight $W_H$ at a coefficient generator 318 to produce a signal $E_{WH \cdot \{l6\ cos\ \alpha 1+l10 \cdot sin(\alpha 1+\beta 1+\beta 2)\}}$. This signal is added to the signal $E_{WG \cdot l6 \cdot cos(\alpha 1+\alpha 4)}$ at an adder 320 to produce a signal $E_{WG \cdot l6\ cos(\alpha 1+\alpha 4)+WH\{l6 \cdot cos\ \alpha 1+l10\ sin(\alpha 1+\beta 1+\beta 2)\}}$.

The output signal $E_{\alpha 1+\beta 2}$ of the adder 306 is inputted to a trigonometric function generator 322 from which a signal $E_{sin(\alpha 1+\beta 1)}$ corresponding to the sine of the angle $(\alpha_1+\beta_1)$ is taken out and multiplied by a signal corresponding to the distance $l_7$ at a coefficient generator 324 to produce a signal $E_{l7\ sin(\alpha 1+\beta 1)}$. The output signal of the adder 306 is added to a bucket angle signal $E_{\gamma 1}$ at an adder 328 to produce a signal $E_{\alpha 1+\beta 1+\gamma 1}$, and added to a signal corresponding to an angle $\gamma_2$ in a memory 332 at an adder 332 to produce a signal $E_{\alpha 1+\beta 1+\gamma 1+\gamma 2}$. This signal is inputted to a trigonometric function generator 334 from which a signal $E_{sin(\alpha 1+\beta 1+\gamma 1+\gamma 2)}$ corresponding to the sine of an angle $(\alpha_1+\beta_1+\gamma_1+\gamma_2)$ is taken out and multiplied by a signal corresponding to the distance $l_{11}$ at a coefficient generator 336 to produce a signal $E_{l11\ sin(\alpha 1+\beta 1+\gamma 1+\gamma 2)}$. At a subtractor 338, subtraction is performed on this signal and the output signal of the adder 326, and the difference is multiplied by a signal corresponding to the weight $W_I$ at a coefficient generator 340 to produce a signal $E_{WI\ \{l6\ cos\ \alpha 1+l7\ sin(\alpha 1+\beta 1)-l11\ sin(\alpha 1+\beta 1+\gamma 1+\gamma 2)\}}$. This signal is added to the output signal of the adder 320 at an adder 342 which produces a signal $E_{M2}$ corresponding to the loadless moment $M_2$ shown in equation (4).

Correction of the signal $E_{M2}$ obtained as aforesaid is effected as follows. As shown in FIG. 17, the signal $E_{M2}$ is inputted, together with a signal $E_{M0}$ from the front moment calculating section 50, to the subtracter 288 which produces a signal $E_{M0-M2}$ corresponding to the difference between the two signals. The singal $E_{M0-M2}$ is inputted to the divider 290 together with a signal $E_{LI}$ corresponding to a distance $L_I$. Here, the signal $E_{LI}$ is nothing but the output of the subtracter 338 shown in FIG. 18. The divider 290 performs calculation only when the signal $E_s$ from the signal generating unit 224 is inputted thereto, so that the signal $E_{M0}$ corresponding to the loadless moment $M_0$ produced when the bucket carries no load. Thus, the operation performed at the divider 290 represents the operation of equation (17), and the divider 290 outputs a signal $E_{\Delta WI}$ corresponding to the value $\Delta W_I$. Referring to FIG. 18 again, the signal $E_{\Delta WI}$ is inputted to the loadless moment calculating section 284 and stored in a memory 346. Meanwhile the bucket weight $W_I$ is stored in a memory 348, and the signals $E_{\Delta WI}$ and $E_{WI}$ outputted from the two memories 346 and 348 are added together at an adder 350 to produce a signal $E_{WI+\Delta WI}$ which is multiplied by a signal $E_{LI}$ at a multiplier 352 to produce a signal corresponding to the third term of equation (18), $(W_I+\Delta W_I)$. $\{l_6\ cos\ \alpha_1+l_7\ sin(\alpha_1+\beta_1)-l_{11}\ sin(\alpha_1+\beta_1+\gamma_1+\gamma_2)\}$. This signal is added to the output signal of the adder 320 at an adder 354, to produce a signal $E_{M20}$ which corresponds to the loadless moment $M_{20}$.

Figure 19:
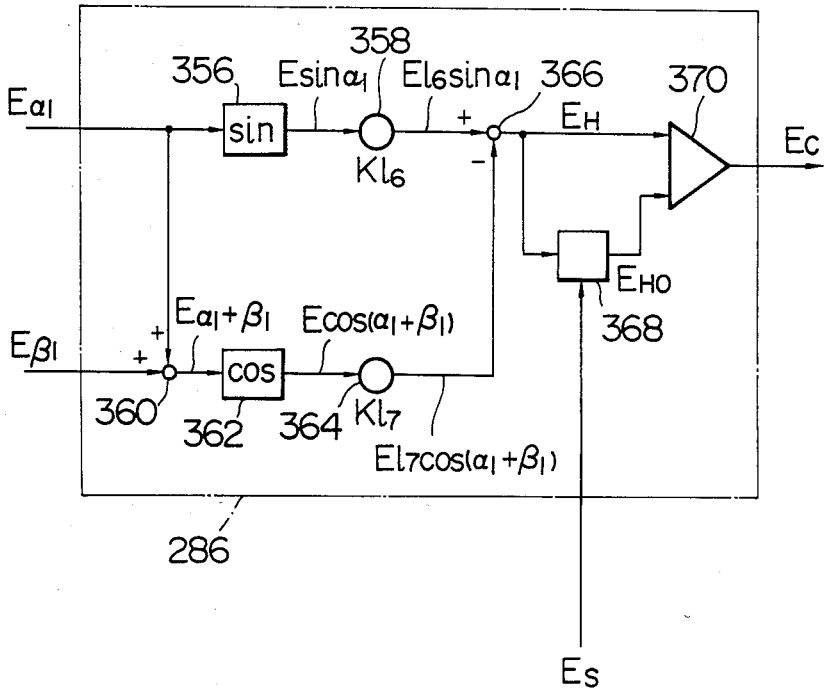

Referring to FIG. 19, the construction and operation of the set position judging section 286 will be described.

The boom angle signal $E_{\alpha 1}$ is inputted to a trigonometric function generator 356 from which a signal $E_{sin\ \alpha 1}$ is supplied to a function generator 358 which produces a signal $E_{l6\ sin\ \alpha 1}$. Meanwhile, the arm angle signal $E_{\ 1}$ is added to the angle $E_{\alpha 1}$ at an adder 360 to produce a signal $E_{\alpha 1+\beta 1}$ which is changed to a signal $E_{l7\ cos(\alpha 1+\beta 1)}$ while being passed through a trigonometric function generator 362 and a coefficient generator 364. At a subtracter 366, the difference between the two signals is obtained, to produce a signal $E_H=E_{l6\ sin\ \alpha 1-l7\ cos(\alpha 1+\beta 1)}$ which represents a vertical position H of point C in FIG. 3. The signal $E_H$ is stored as a signal $E_{H0}$ in a memory 368 when the signal $E_s$ is inputted from the signal generating unit 224, and the two signals $E_H$ and $E_{H0}$ are compared with each other at a comparator 370, to produce a signal $E_c$ for giving a command to perform calculation on the weight of a load or integration of the weight of loads when $E_H \geqq E_{H0}$, for example. The embodiment described hereinabove is one in which judgement is passed based on the position in the vertical direction. However, this is not restrictive and judgement may be passed based on either the position in the horizontal direction or the output of an OR or AND resulted from judgement of the two positions.

For effecting correction of the loadless moment $M_2$, other means than one relying on correction of the bucket weight $W_I$, such as means relying on multiplication or addition of a suitable constant, may be used.

From the foregoing description, it will be appreciated that in the embodiment of the invention shown and described hereinabove, a value approximating the actual loadless moment of the front attachment itself is used by correcting the loadless moment due to the structural weight of the front attachment, and thus, it is possible to obtain the weight of a load with increased accuracy as compared with the embodiment shown in FIG. 3. It will be also appreciated that the corrected loadless moment can be obtained only by calculation no matter what the posture of the front attachment may be, so that the set position judging section may be made to produce a command signal when the position of the front attachment either in the horizontal direction or in the vertical direction has reached the set position to perform calculation on the weight of a load. This makes it possible to positively perform calculation even if the path of movement of the load may slightly vary from one operation to another.

A fifth embodiment of the invention will now be described by referring to FIGS. 20–27.

In all the first to forth embodiments shown and described hereinabove, the position of the center of gravity of a load in the bucket has been assumed to be in the fixed point J shown in FIG. 4. However, the center of gravity of the load carried by the bucket 14 of a hydraulic excavator would vary each time the load is placed in the bucket 14 depending on the type and amount of the load and the manner in which the load is placed in the bucket. Thus, if the actual position of the center of gravity did not coincide with the position in which the center of gravity was assumed to exist, the weight of the load obtained by calculation would not be accurate. This embodiment proposes to obviate this disadvantage.

Figure 20:
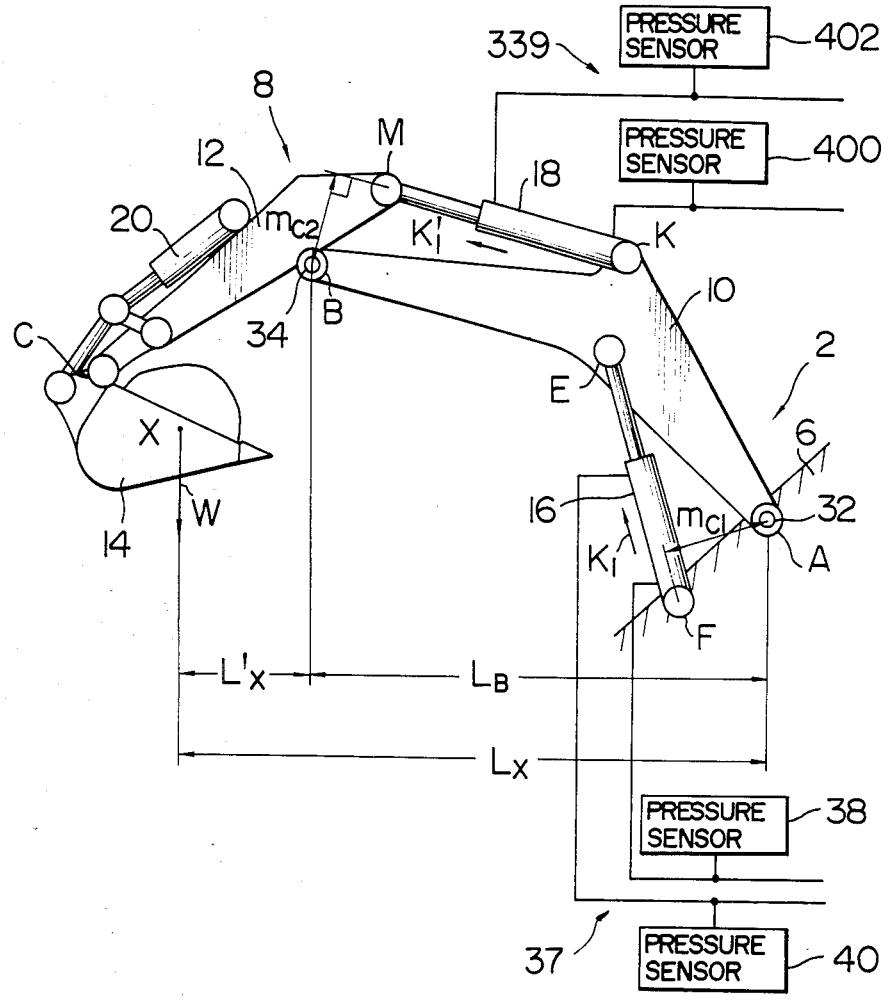
FIG. 20 is a side view of the front attachment of a hydraulic shovel in which is incorporated the load weight indicating system comprising a fifth embodiment.

FIG. 20 is a side view of the front attachment of a hydraulic excavator equipped with detector means used with the load weight indicating system according to the invention in which parts similar to those of the embodiment shown in FIGS. 1–5 are designated by like reference characters. The reference numeral 399 designates a pressing force sensor including a pressure sensor 400 for sensing a pressure on the head side of the arm cylinder 18, and a pressure sensor 402 for sensing a pressure on the bottom side of the arm cylinder 18. The symbols K and M designate a pivot of the arm cylinder 18 pivotally supported by the boom 10 and a point at which a rod of the arm cylinder 18 and the arm are connected for pivotal movement, respectively. X designates a position in which the center of gravity of a load actually exists. The horizontal distance between the pivot A and the position of the center of gravity X of the load, the horizontal distance between the pivots A and B, the horizontal length between the pivot B and the position of the center of gravity X, the length of a perpendicular extending from a line $\overline{EF}$ to the pivot A, and the length of a perpendicular extending from a line $\overline{KM}$ to the pivot B are designated by $L_X$, $L_B$, $L'_X$, $m_{c1}$ and $m_{c2}$, respectively.

Figure 21:
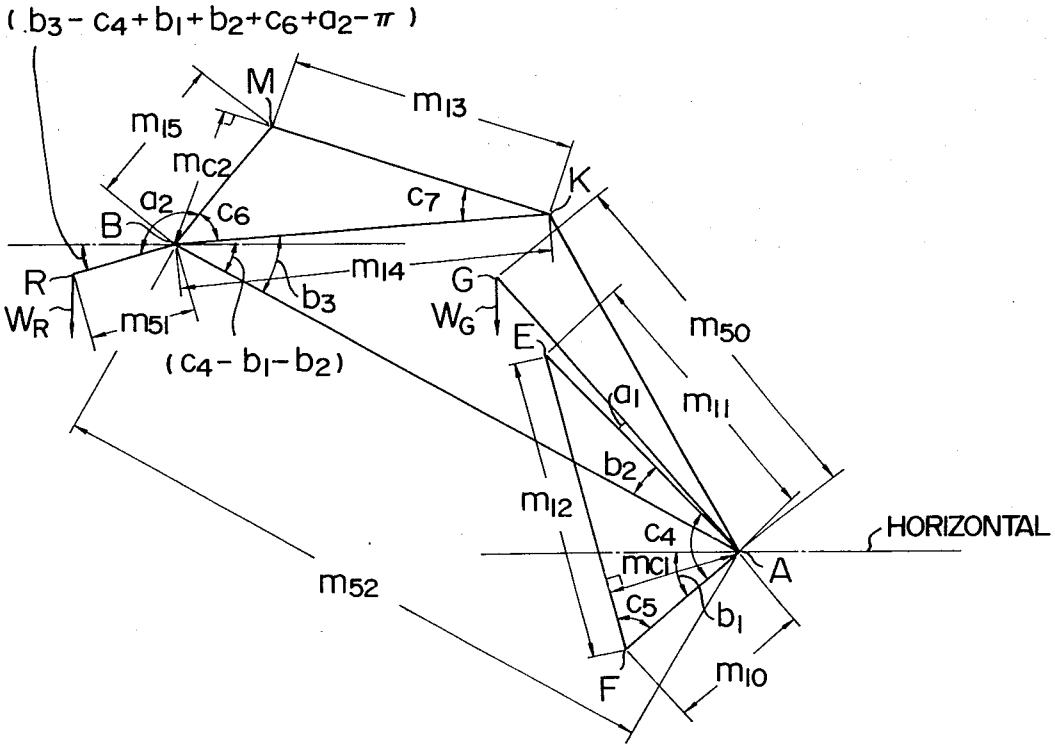
FIG. 21 is a view in explanation of the principle of calculation with regard to the fifth embodiment, showing the front attachment in skeleton form with various measurements of various sections.

FIG. 21 shows is skeleton form the front attachment of the hydraulic excavator shown in FIG. 20, showing the measurements of various parts of the front attachment. The distance between the pivots A and F, the distance between the pivot A and the connecting point E, the distance between the pivot F and the connecting point E, the angle formed by lien $\overline{AE}$ and $\overline{AF}$ and the angle formed by lines $\overline{AF}$ and $\overline{FE}$ are designated by $m_{10}$, $m_{11}$, $m_{12}$, $c_4$ and $c_5$, respectively. The distance between the pivot K and the connecting point M, the distance between the pivots K and B, the distance between the pivots M and B, the angle formed by lines $\overline{BM}$ and $\overline{BK}$ and the angle formed by lines $\overline{KM}$ and $\overline{KB}$ are designated by $m_{13}$, $m_{14}$, $m_{15}$, $c_6$ and $c_7$, respectively. The position of the center of gravity of the boom is designated by G, and the distance between the pivot A and the position G of the center of gravity and the angle formed by the line $\overline{AE}$ and a line $\overline{AG}$ are designated by $m_{50}$ and $a_1$, respectively. The weight of the boom and the position of the center of the composite gravity of the arm and the bucket are designated by $W_G$ and R, respectively, and the distance between the pivot B and the position R of the center of the composite gravity of the arm and bucket and the distance between the pivots A and B are designated by $m_{51}$ and $m_{52}$, respectively. The angle formed by lines $\overline{BM}$ and $\overline{BR}$, the angle formed by the horizontal (designated by a phantom line) and the line $\overline{AF}$, the angle formed by the lines $\overline{AB}$ and $\overline{AE}$, and the angle formed by the lines $\overline{AB}$ and $\overline{BK}$ are designated by $a_2$, $b_1$, $b_2$ and $b_3$, respectively. The total weight of the arm and the bucket are designated by $W_R$.

Let us now discuss a moment of rotation about the pivot A. The weight W of a load of the bucket 14 produces a moment $W \cdot L_X$ which, as described by referring to the first embodiment, is equal to the value obtained by subtracting the loadless moment $M_2$ produced by the front attachment from the moment $M_1$ produced by the front attachment carrying a load. Thus, the following relation holds:

$$W = \frac{M_1 - M_2}{L_X} \tag{19}$$

In equation (19), $L_X$ is unknown because the center of gravity X of the load is not constant. Thus, it would be necessary to use another equation including $L_X$ to eliminate the unknown quantity $L_X$. To this end, a moment of rotation about the pivot B would be considered. With regard to the pivot B, the weight W of the load of the bucket 14 produces a moment $W \cdot L'_X$ which, like the moment $W \cdot L_X$ described hereinabove, is equal to the value obtained by subtracting a loadless moment $M_{2B}$ of the front attachment from a moment $M_{1B}$ of the front attachment carrying a load. Thus, the following relation holds:

$$W = \frac{M_{1B} - M_{2B}}{L'_X} \tag{20}$$

Equation (20) can be rewritten as follows because $L'_X = L_X - L_B$:

$$W = \frac{M_{1B} - M_{2B}}{L_X - L_B} \tag{21}$$

By eliminating the unknown quantity $L_X$ from equations (19) and (21), the following relation can be established:

$$W = \frac{1}{L_B} \{(M_1 - M_2) - (M_{1B} - M_{2b})\} \tag{22}$$

Meanwhile, the moment $M_1$ produced by the front at attachment about the pivot A can be expressed as follows because the pressing force $K_1$ exerted by the boom cylinder 16 produces a moment which balances with the moment $M_1$:

$$M_1 = K_1 \cdot m_{c1}$$

If the pressure receiving area of the bottom side of the boom cylinder 16, the pressure applied to the bottom side of the boom cylinder 16, the pressure receiving area of the rod side of the boom cylinder 16 and the pressure applied to the rod side of the boom cylinder 16 are designated by $S_b$, $P_b$, $S_r$ and $P_r$ respectively, then the following relation holds: $K_1 = 2(P_b \cdot S_b - P_r \cdot S_r)$ with two cylinders 16. Thus, the pressing force $K_1$ can be obtained by detecting the pressures $P_b$ and $P_r$ applied to the bottom side and rod side of the boom cylinder 16 by means of pressure sensors 38 and 40, respectively forming part of the pressing force 37.

The length $m_{c1}$ can be expressed by the following equation:

$$m_{c1} = m_{10} \sin c_5$$

The length $m_{10}$ is known but the angle $c_5$ is unknown. However, the angle $c_5$ can be obtained by the following equation:

$$c_5 = \sin^{-1}\left(\frac{m_{11}}{m_{12}} \sin c_4\right)$$

because $m_{11} \sin c_4 = m_{12} \sin c_5$ and $m_{12} = (m_{10}^2 + m_{11}^2 - 2 \cdot m_{10} \cdot m_{11} \cos c_4)^{\frac{1}{2}}$. The lengths $m_{10}$ and $m_{11}$ are known and the angle $c_4$ can be obtained by the angle detector 32.

The loadless moment $M_2$ about the pivot A can be expressed as follows:

$$M_2 = w'm' = W_G \cdot m_{50} \cos(c_4 + a_1 - b_1) - W_R \cdot \{m_{52} \cdot \cos(c_4 - b_1 - b_2) + m_{51} \cos(b_1 + b_2 + b_3 - c_4 + a_2 - \pi\}$$

Here, the values other than those of $c_4$, $c_6$, $a_2$ and $m_{51}$ are known, and the values of $c_4$ and $c_6$ can be obtained by the angle detectors 32 and 34, respectively. The position R of the center of composite gravity of the arm and bucket when the bucket 14 is in the typical operating position can be set beforehand. Thus, $m_{51}$ is known and the value of $a_2$ can be obtained by the angle detector 34. When a bucket angle detector is provided additionally, the position of the center of composite gravity of the arm and bucket can be obtained based on the value obtained by the bucket angle detector and the respective positions of the centers of gravity of the arm and bucket. Thus, the value of line $m_{51}$ can be obtained, and by using the value of the arm angle $c_6$ together, the value of $a_2$ can be obtained.

Since the moment $M_{1B}$ produced by the front attachment about the pivot B balances with a moment of rotation about the pivot B due to the pressing force $K'_1$ exerted by the arm cylinder 18, the moment $B_{1B}$ and be expressed as follows:

$$M_{1B} = K'_1 \cdot m_{c2}$$

If the pressure receiving area of the head side of the arm cylinder 18, the pressure applied to the head side of the arm cylinder 18, the pressure receiving area of the rod side of the arm cylinder 18 and the pressure applied by the rod side of the arm cylinder 18 are designated by $S_h$, $P_h$, $S'_r$ and $P'_r$, respectively, the following relation holds: $K'_1 = 2(P'_r \cdot S'_r - P_h \cdot S_h)$ with two arm cylinders 18. The pressures $P'_r$ and $P_h$ can be sensed by the pressure sensors 400 and 402, respectively, forming part of the pressing force sensor 399 and the areas $S'_r$ and $S_h$ are known. The length $m_{c2}$ can be expressed by the following equation:

$$m_{c2} = m_{14} \sin c_7$$

The length $m_{14}$ is known and the angle $c_7$ is unknown. However, the angle $c_7$ can be obtained by the following equation:

$$c_7 = \sin^{-1}\left(\frac{m_{15}}{m_{13}} \sin c_6\right)$$

because $m_{15} \sin c_6 = m_{13} \sin c_7$ and $m_{13} = (m_{14}^2 + m_{15}^2 - 2 \cdot m_{14} \cdot m_{15} \cos c_6)^{\frac{1}{2}}$. Here, the lengths $m_{14}$ and $m_{15}$ are known, the angle $c_6$ can be obtained by the angle detector 34. Thus, the length $m_{13}$ can be calculated and the angle $c_7$ can be obtained.

The loadless moment $M_{2B}$ about the pivot A can be expressed as follows:

$$M_{2B} = W_R \cdot m_{51} \cos(b_1 + b_2 + b_3 - c_4 + c_6 + a_2 - \pi)$$

Here, other values than those of $c_4$, $c_6$, $a_2$ and $m_{51}$ are known, and the values of $c_4$ and $c_6$ can be obtained by the angle detectors 32 and 34, respectively. Also, the values of $a_2$ and $m_{51}$ can be made known as described hereinabove.

By substituting the values of $M_1$, $M_2$, $M_{1B}$ and $M_{2B}$ into equation (22), it can be changed to the following equation:

$$W = \frac{1}{L_B} \{K_1 \cdot m_{c1} - K'_1 \cdot m_{c2} - w'l' + W_R \cdot m_{51} \cos(b_1 + b_2 + b_3 - c_4 + c_6 + a_2 - \pi)\}$$

All the values shown in this equation are known as described hereinabove, so that they can obtained by the detectors 32 and 34 and sensors 38, 40, 400 and 402. Thus, the weight W of the load can be obtained.

By eliminating W in equations (19) and (21), the horizontal distance $L_X$ can be also obtained by the following equation:

$$L_X = \frac{K_1 \cdot L_B \cdot m_{c1}}{K_1 \cdot m_{c1} - K'_1 \cdot m_{c2}}$$

Figure 22:
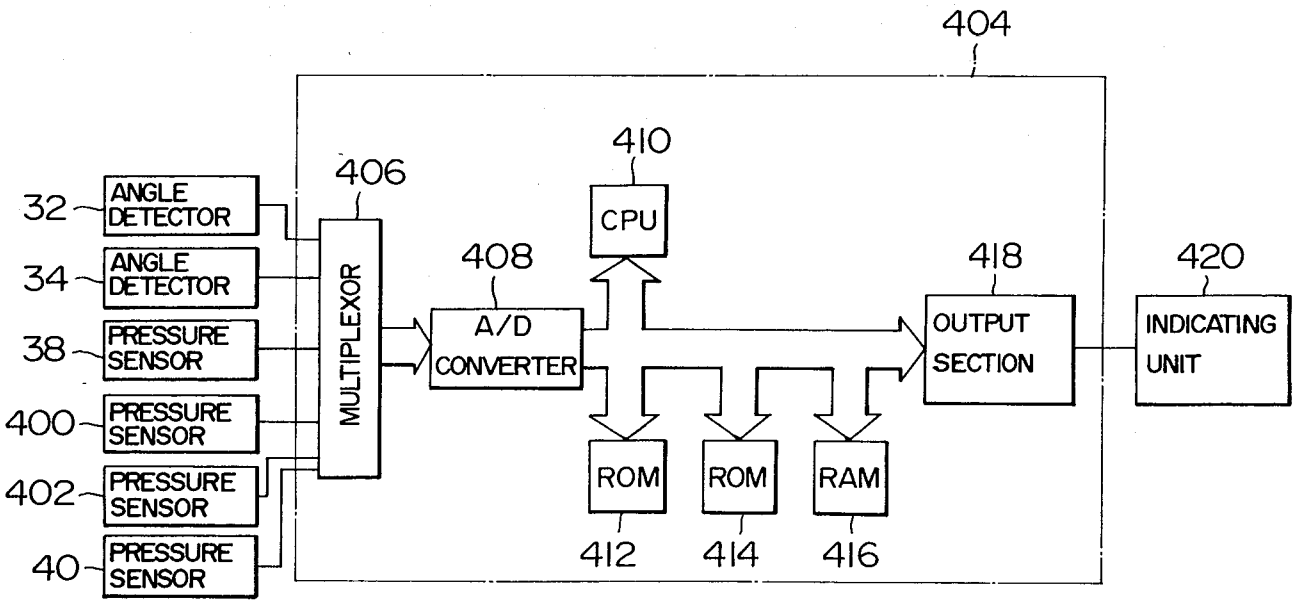
FIG. 22 is a block diagram of the load weight indicating system comprising the fifth embodiment.

FIG. 22 is a block diagram of a load weight calculating system for a hydraulic excavator comprising the fifth embodiment. The numerals 32 and 34 designate the angle detectors shown in FIG. 20, and the numerals 38, 40, 400 and 402 designate the pressure sensors shown in FIG. 20 forming parts of the pressing force sensors. The numeral 404 designates a calculating unit constituted by a microcomputer comprising a multi-plexor 406 having inputted thereto signals produced by the detectors 32 and 34 and sensors 38, 40, 400 and 402 and successively switched, an A/D converter 408 for converting the inputted signals into digital values, a central processor unit 410 for performing the required calculation and control, read-only-memory 412 for storing the procedures followed by the central processor unit 410, a read-only-memory 414 for storing the known values of lengths $m_3$, $m_{10}$, $m_{11}$, $m_{14}$ and $m_{15}$ and the sectional areas $S_b$, $S_r$, $S'_b$ and $S'_r$ of the cylinders, a random-access-memory 416 for temporarily storing the inputted values and the results of calculation, and an output section 418 for outputting the results of calculation. The results of calculation obtained by the calculating unti 404 are supplied to an indicating unit 420.

In operation, as a load is placed in the bucket 14, the calculating unit 404 is actuated to successively receive signals from the angle detectors 32 and 34 and the pressure sensors 38, 40, 400 and 402. Based on the values of these signals and the known values stored in the ROM 414, calculation is performed on the various equations described hereinabove by the CPU 410 in accordance with the procedures stored in the ROM 412, to thereby obtain by calculation the weight W of the load. The value of the weight W thus obtained is indicated by the indicating unit 420 which receives an output from the output section 418.

The ROM 414 may be omitted by storing the known values in the ROM 412. The calculating unit 404 may be shared by other actuator of the hydraulic excavator which requires calculation and control.

From the foregoing description, it will be appreciated that in the embodiment of the invention shown and described hereinabove, the moments about the pivot of the arm are obtained in addition to the moments about the pivot of the boom, and therefore it is possible to obtain an accurate weight of a load irrespective of the position of the center of gravity of the load.

What is claimed is:

1. A load weight indicating system for a load moving machine including a support, and a front attachment supported by said support for pivotal movement about a first pivot, said front attachment having a first linkage element supported by said support for pivotal movement about said first pivot, a second linkage element supported by said first linkage element for pivotal movement about a second pivot, a loading section supported by said second linkage element, and first and second hydraulic actuator means mounted for pivotally moving the first linkage element and the second linkage element, respectively;

said load weight indicating system comprising:

first and second displacement detector means for detecting displacement $\alpha_1$ and $\beta_1$ of at least the first linkage element and the second linkage element, respectively, of said front attachment;

pressing force sensor means for obtaining values $P_b$, $P_r$ associated with a pressing force $K_1$ exerted by at least one of the first and second hydraulic actuator means of said front attachment;

weight calculating means for calculating the weight of a load carried by the loading section based on the values $\alpha_1$, $\beta_1$, $P_b$ and $P_r$ obtained at least by the first and second displacement detector means and the pressing force sensor means, respectively;

weight indicating means for indicating a value associated with the load weight obtained by said weight calculating means; and position setting means for setting an arbitrarily selected position of said front attachement;

said weight calculating means including;

(a) a first means for calculating a moment of rotation $M_0$ of the front attachment about the first pivot when the loading section carries no load, based on the values $\alpha_1$, $P_b$ and $P_r$ obtained at least by said first displacement detector means and said pressing force sensor means when the front attachment is moved and passes through a set position set by said position setting means with the loading section carrying no load, (b) a second means for calculating a moment of rotation $M_1$ of the front attachment about the first pivot when the loading section carries a load, based on the values $\alpha_1$, $P_b$ and $P_r$ obtained by said first displacement detector means and said pressing force sensor means when the front attachment is moved and passes through the set position with the loading section carrying the load, (c) a third means for calculating a horizontal distance $L_J$ between a position of the center of gravity of the load in the loading section and the first pivot, based on the values $\alpha_1$ and $\beta_1$ obtained at least by said first and second displacement detector means when the front attachment is moved and passes through the set position, and (d) a fourth means operative to calculate $(M_1-M_0)/L_J$ based on the results of the calculation performed by said first, second and third means.

2. A load weight indicating system as claimed in claim 1, wherein:

said position setting means includes signal generating means for giving a command to have said set position decided, and set position judging means operative to store, as a value indicating the set position, the values $\alpha_1$ and $\beta_1$ obtained by first and second displacement detector means when the command is given by said signal generating means, said set position judging means being further operative to give a command to perform calculation each time values detected by said first and second displacement detector means become substantially equal to said stored values as the front attachment moves thereafter;

said second means includes front moment calculating means for obtaining the moment of rotation $M_1$ based on the values $\alpha_1$, $P_b$ and $P_r$;

said first means includes memory means for storing, as the moment of rotation $M_0$, the result of the calculation performed by said front moment calculating means when the command is given by said signal generating means;

said third means includes load point distance calculating means for calculating the horizontal distance $L_J$ based on the values $\alpha_1$ and $\beta_1$; and said fourth means includes substraction means for calculating $M_1-M_0$ based on the result $M_1$ of the calculation performed by the front moment calculating means and the output $M_0$ of said memory means, and divider means for calculating $(M_1-M_0)/L_J$ based on the result $M_1-M_0$ of the calculation performed by said subtraction means and the result $L_J$ of the calculation performed by the load point distance calculating means when the command is given by said set position judging means.

3. A load weight indicating system as claimed in claim 2, wherein said front moment calculating means is operative to calculate, as said moment of rotation $M_1$, a moment of rotation about the first pivot produced by the pressing force $K_1$ of said first hydraulic actuator means exerted on the front attachment.

4. A load weight indicating system as claimed in claim 1, further comprising third displacement detector means for detecting a displacement $\gamma_1$ of said loading section, and wherein said weight calculating means is operative to calculate the load weight also based on the value $\gamma_1$ obtained by said third displacement detector means.

5. A load weight indicating system as claimed in claim 1, wherein said pressing force sensor means includes pressure sensor means for detecting hydraulic pressure $P_b$, $P_r$ applied to at least one of said first and second hydraulic actuator means.

6. A load weight indicating system for a load moving machine including a support, and a front attachment supported by said support for pivotal movement about a first pivot, said front attachment having a first linkage element supported by said support for pivotal movement about said first pivot, a second linkage element supported by said first linkage element for pivotal movement about a second pivot, a loading section supported by said second linkage element, and first and second hydraulic actuator means mounted for pivotally moving the first linkage element and the second linkage element, respectively;

said load weight indicating system comprising:

first and second displacement detector means for detecting displacement $\alpha_1$ and $\beta_1$ of at least the first linkage element and the second linkage element, respectively, of said front attachment;

pressing force sensor means for obtaining values $P_b$, $P_r$ associated with a pressing force $K_1$ exerted by at least one of the first and second hydraulic actuator means of said front attachment;

weight calculating means for calculating the weight of a load carried by the loading section based on the values $\alpha_1$, $\beta_1$, $P_b$ and $P_r$ obtained at least by the first and second displacement detector means and the pressing force sensor means, respectively;

weight indicating means for indicating a value associated with the load weight obtained by said weight calculating means; and position setting means for setting an arbitrarily selected position of said front attachment;

said weight calculating means including;

(a) a first means for calculating a moment of rotation $M_{20}$ of the front attachment about the first pivot when the loading section carries no load, based on the values $\alpha_1$, $P_b$ and $P_r$ obtained at least by said first displacement detector means and said pressing force sensor means when the front attachment is moved and passes through a first set position set by said position setting means with the loading section carrying no load, (b) a second means for calculating a moment of rotation $M_1$ of the front attachment about the first pivot when the loading section carries a load, based on the values $\alpha_1$, $P_b$ and $P_r$ obtained by said first displacement detector means and said pressing force sensor means when the front attachment is moved and passes through a second set position set by said position setting means with the loading section carrying the load, (c) a third means for calculating a horizontal distance $L_J$ between a postion of the center of gravity of the load in the loading section and the first pivot, based on the values $\alpha_1$ and $\beta_1$ obtained at least by said first and second displacement detector means when the front attachment is moved and passes through the second set position with the loading section carrying the load, and (d) a fourth means operative to calculate $(M_1-M_0)/L_J$ based on the results of the calculation performed by said first, second and third means.

7. A load weight indicative system as claimed in claim 6, wherein:

said position setting means includes signal generating means for giving commands to have said first and second set positions decided, and set position judging means operative to store, as a value indicating the second set position, a value obtained by calculation from at least one of the values $\alpha_1$ and $\beta_1$ obtained by said first and second displacement detector means when the command is given by said signal generating means, said set position judging means being further operative to give a command to perform calculation each time a corresponding value obtained by calculation from at least one of the values detected by said first and second displacment detector means becomes substantially equal to said stored value as the front attachment moves thereafter;

said second means includes front moment calculating means for obtaining the moment of rotation $M_1$ based on the values $\alpha_1$, $P_b$ and $P_r$;

said first means includes said front moment calculating means for calculating a moment of rotation $M_0$ of the front attachment about the first pivot when the loading section carries no load based on the values $\alpha_1$, $P_b$ and $P_r$ and loadless moment calculating means for calculating a moment of rotation $M_2$ of the front attachment about the first pivot when the loading section carries no load based on the values $\alpha_1$ and $\beta_1$ obtained by said first and second displacement detector means, structural gravity center distance calculating means for calculating a horizontal distance $L_I$ between the structural center of gravity of said loading section and the first pivot based on the values $\alpha_1$ and $\beta_1$, first subtraction means for calculating $M_0-M_2$ based on the result $M_0$ of calculation performed by the front moment calculating means and the result $M_2$ of calculation means, and first divider means for calculating $\Delta W_I=(M_0-M_2)/L_I$ based on the result $L_I$ of calculation performed by said structural gravity center distance calculating means and the result $M_0-M_2$ of calculation performed by the first subtraction means when the command is given by said signal generating means, said loadless moment calculating means being operative to have inputted thereto the result $\Delta W_I$ of calculation performed by said first divider means and change the weight $W_I$ of the loading section already stored to $W_I+\Delta W_I$ to thereby calculate a corrected loadless moment of rotation as said moment of rotation $M_{20}$;

said third means includes load point distance calculating means for calculating the horizontal distance $L_J$ based on the values $\alpha_1$ and $\beta_1$; and said fourth means includes second subtraction means for calculating $M_1-M_{20}$ based on the result $M_1$ of calculation performed by the front moment calculating means and the result $M_{20}$ of calculation performed by the loadless moment calculating means, and second divider means for calculating $(M_1-M_{20})/L_J$ based on the result $M_1-M_{20}$ of calculation performed by the second subtraction means and the result $L_J$ of calculation performed by the load point distance calculating means when the command is given by said set position judging means.

8. A load weight indicating system as claimed in claim 7, wherein said front moment calculating means is operative to calculate, as said moment of rotation $M_0$, $M_1$, a moment of rotation about the first pivot produced by the pressing force $K_1$ of said first hydraulic actuator means exerted on the front attachment.

9. A load weight indicating system as claimed in claim 7, wherein said loadless moment calculating means is operative to calculate, as said moment of rotation $M_2$, a moment of rotation about the first pivot produced by the structural weight $W_G$ and $W_H$ of the first and second linkage elements and the structural weight $W_I$ of the loading section, and to calculate, as said corrected loadless moment of rotation $M_{20}$, a moment of rotation about the first pivot produced by the structural weights $W_G$ and $W_H$ of the first and second linkage elements and the amended structural weight $W_I+\Delta W_I$ of the loading section.

10. A load weight indicating system as claimed in claims 7, wherein said set position judging means is operative to calculate, as said value indicating said second set position, one of a horizontal and vertical position of the front attachment based on the value $\alpha_1$ and $\beta_1$ obtained by said first and second displacement detector means, and to give a command to perform calculation each time the front attachment passes through said one of the horizontal and vertical positions.

11. A load weight indicating system as claimed in claim 7, further comprising third displacement detector means for detecting a displacement $\gamma_1$ of said loading section, and wherein said weight calculating means is operative to calculate the load weight also based on the value $\gamma_1$ obtained by said third displacement detector means.

12. A load weight indicating system as claimed in claim 7, wherein said pressing force sensor means include pressure sensor means for detecting hydraulic pressure $P_b$, $P_r$ applied to at least one of said first and second hydraulic actuator means.

13. A load weight indicating system for a load moving machine including a support, and a front attachment supported by said support for pivotal movement about a first pivot, said front attachment having a first linkage element supported by said support for pivotal movement about said first pivot, a second linkage element supported by said first linkage element for pivotal movement about a second pivot, a loading section supported by said second linkage element, and first and second hydraulic actuator means mounted for pivotally moving the first linkage element and the second linkage element, respectively;

said load weight indicating system comprising:

first and second displacement detector means for detecting displacement $\alpha_1$ and $\beta_1$ of at least the first linkage element and the second linkage element, respectively, of said front attachment;

first pressing force sensor means for obtaining values $P_b$, $P_r$ associated with a pressing force $K_1$ exerted by at least one of the first and second hydraulic actuator means of said front attachment;

weight calculating means for calculating the weight of a load carried by the loading section based on the values $\alpha_1$, $\beta_1$, $P_b$ and $P_r$ obtained at least by the first and second displacement detector means and the first pressing force sensor means, respectively;

weight indicating means for indicating a value associated with the load weight obtained by said weight calculating means;

said weight calculating means being operative to preform, based on the values $\alpha_1$, $\beta_1$, $P_b$ and $P_r$ obtained at least by the first and second displacement detector means and the first pressing force sensor means, the operations of;

(a) calculating a moment of rotation $M_1$ of the front attachment about the first pivot when the loading section carries a load, (b) calculating a moment of rotation $M_2$ of the front attachment about the first pivot when the loading section carries no load, (c) calculating a horizontal distance $L_x$ between a position of the center of gravity of a load in the loading section and the first pivot, and (d) calculating $(M_1-M_2)/L_x$; and second pressing force sensor means for obtaining values $P_h$, $P'_r$ associated with a pressing force $K'_1$ of the other of said first and second hydraulic actuator means of said front attachment;

said weight calculating means being further operative to perform, based on the values $\alpha_1$, $\beta_1$, $P_h$ and $P_r$ obtained at least by said first and second displacement detector means and said second pressing force sensor means, the following operation in addition to the operations (a), (b), (c) and (d) performed with regard to the moment about the first pivot;

(e) calculating a moment of rotation $M_{1B}$ of the front attachment about the second pivot when the loading section carries a load, (f) calculating a moment of rotation $M_{2B}$ of the front attachment about the second pivot when the loading section carries no load, (g) calculating a horizontal distance $L_x-L_B$ between the position of the center of gravity of the load in the loading section and the second pivot, (h) calculating $(M_{1B}-M_{2B})/L_x-L_B$, and (i) erasing the horizontal distance $L_x$ between the position of the center of gravity of the load and the first pivot based on the formulas of (d) and (h) to thereby obtain a weight of the load in the loading section.

14. A load weight indicating system as claimed in claim 13, wherein said pressing force sensor means includes pressure sensor means for detecting hydraulic pressure $P_b$, $P_r$ applied to at least one of said first and second hydraulic actuator means.

* * * * *